US010738953B2

(12) United States Patent
Sonneman et al.

(10) Patent No.: US 10,738,953 B2
(45) Date of Patent: Aug. 11, 2020

(54) LIGHTING SYSTEM INCLUDING A TRUSS STRUCTURE OR A PLATFORM OF POWER BARS

(71) Applicant: CONTEMPORARY VISIONS, LLC, Larchmont, NY (US)

(72) Inventors: Robert A. Sonneman, Mamaroneck, NY (US); Christian N. Garnett, Mount Kisco, NY (US)

(73) Assignee: CONTEMPORARY VISIONS, LLC, Larchmont, NY (US)

( * ) Notice: Subject to any disclaimer, the term of this patent is extended or adjusted under 35 U.S.C. 154(b) by 0 days.

(21) Appl. No.: 16/669,348

(22) Filed: Oct. 30, 2019

(65) Prior Publication Data

US 2020/0132266 A1 Apr. 30, 2020

Related U.S. Application Data

(60) Provisional application No. 62/752,648, filed on Oct. 30, 2018.

(51) Int. Cl.
*F21S 8/06* (2006.01)
*F21S 8/04* (2006.01)
(Continued)

(52) U.S. Cl.
CPC ..... *F21S 8/061* (2013.01); *F21S 8/046* (2013.01); *F21V 23/001* (2013.01); *F21S 8/043* (2013.01);
(Continued)

(58) Field of Classification Search
CPC ..... H01R 25/14; F21V 21/112; F21V 21/116; F21V 21/34; F21V 21/35; F21V 21/008;
(Continued)

(56) References Cited

U.S. PATENT DOCUMENTS 1,950,130 A 3/1934 Barlow
2,905,806 A * 9/1959 Tunney ..... B66C 7/04 362/459

(Continued)

FOREIGN PATENT DOCUMENTS

EP 000337115 A2 * 3/1989 ..... H01R 25/14
WO WO9964786 * 12/1999 ..... F21V 21/34

OTHER PUBLICATIONS

USPTO, Notice of Allowance and PTO892-Form dated Apr. 17, 2019 issued in corresponding Design U.S. Appl. No. 29/674,515 dated Sep. 10, 2019.

(Continued)

*Primary Examiner* — Tho D Ta
(74) *Attorney, Agent, or Firm* — Gottlieb Rackman & Reisman PC

(57) ABSTRACT

A lighting system that may include a platform, a plurality of hangers configured to hang the platform from a supporting structure, and at least one luminaire or light pendant electrically and structurally coupled to the platform for emitting light.

The platform may include a plurality of first power bars spaced from one another and extending in a first direction, and a plurality of second power bars spaced from one another and extending in a second direction crossing the first direction. The first and second power bars may be electrically and structurally connected to one another.

20 Claims, 33 Drawing Sheets

(51) Int. Cl.

| | |
|---|---|
| ***F21V 23/00*** | (2015.01) |
| *F21V 21/35* | (2006.01) |
| *F21V 21/008* | (2006.01) |
| *F21V 21/112* | (2006.01) |
| *F21V 21/116* | (2006.01) |
| *F21V 21/34* | (2006.01) |
| *H01R 25/14* | (2006.01) |

(52) U.S. Cl.
CPC ..... *F21S 8/06* (2013.01); *F21S 8/065* (2013.01); *F21S 8/066* (2013.01); *F21V 21/008* (2013.01); *F21V 21/112* (2013.01); *F21V 21/116* (2013.01); *F21V 21/34* (2013.01); *F21V 21/35* (2013.01); *H01R 25/14* (2013.01)

(58) Field of Classification Search
CPC .... F21S 8/043; F21S 8/046; F21S 8/06; F21S 8/065; F21S 8/066
See application file for complete search history.

(56) References Cited

U.S. PATENT DOCUMENTS

| | | | | | |
|---|---|---|---|---|---|
| 4,420,798 | A * | 12/1983 | Herst | E04B 9/064 | 362/145 |
| 4,712,165 | A * | 12/1987 | Cetrone | F21S 2/00 | 362/147 |
| D296,139 | S | 7/1988 | Maurer | | |
| 4,837,667 | A | 6/1989 | Grau | | |
| 5,025,357 | A | 6/1991 | Maurer | | |
| 5,412,552 | A * | 5/1995 | Fernandes | F21S 2/00 | 174/101 |
| 5,517,393 | A * | 5/1996 | Townsend, Jr. | F21V 19/04 | 362/233 |
| 6,026,626 | A * | 2/2000 | Fisher | E04C 3/08 | 52/28 |
| 6,170,967 | B1 * | 1/2001 | Usher | F21V 23/06 | 200/227 |
| 7,503,530 | B1 * | 3/2009 | Brown | F16M 11/34 | 248/176.1 |
| D619,291 | S | 7/2010 | Thevenot | | |
| D674,955 | S | 1/2013 | Sonneman | | |
| D715,986 | S | 10/2014 | Anastassiades | | |
| D772,468 | S | 11/2016 | Sonneman | | |
| D773,718 | S | 12/2016 | Sonneman | | |
| D790,106 | S | 6/2017 | Lee et al. | | |
| 9,777,899 | B2 * | 10/2017 | Sonneman | F21V 21/104 | |
| D826,461 | S | 8/2018 | Sonneman | | |
| D841,862 | S | 2/2019 | Lee et al. | | |
| 2005/0286256 | A1 * | 12/2005 | Tran | E04B 9/006 | 362/404 |
| 2009/0146910 | A1 | 6/2009 | Gardner | | |
| 2009/0201687 | A1 * | 8/2009 | Calleja | F21V 21/35 | 362/431 |
| 2015/0315786 | A1 * | 11/2015 | Callahan | F21S 2/00 | 52/652.1 |
| 2016/0146445 | A1 | 5/2016 | Shine | | |
| 2017/0030561 | A1 * | 2/2017 | Dix | F21S 2/005 | |
| 2017/0198872 | A1 | 7/2017 | Sonneman | | |
| 2017/0198892 | A1 | 7/2017 | Sonneman | | |
| 2018/0128467 | A1 | 5/2018 | Sonneman | | |

OTHER PUBLICATIONS

ISA/US, PCT International Search Report and Written Opinion dated Jan. 21, 2020 issued in corresponding PCT International Application No. PCT/US19/58937.

* cited by examiner

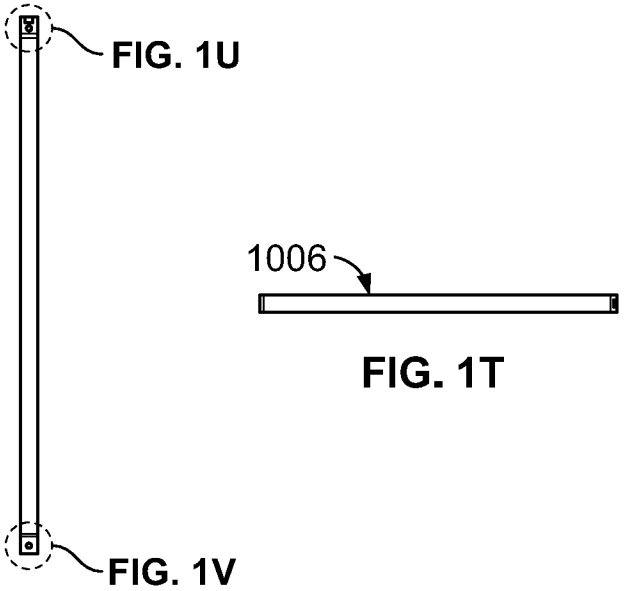
FIG. 1S
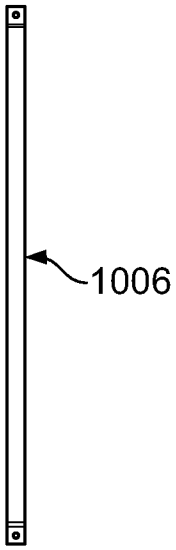
FIG. 1R
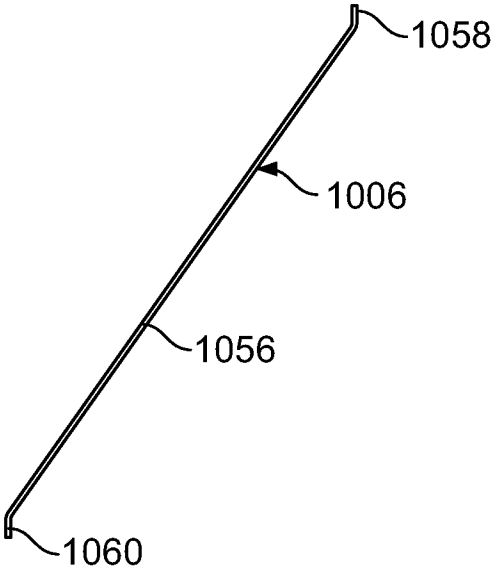
FIG. 1Q
FIG. 1T

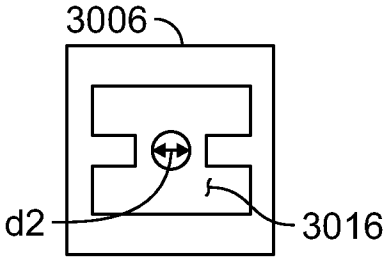
FIG. 3C
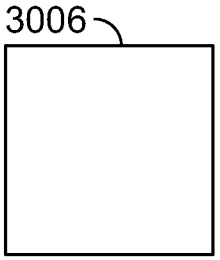
FIG. 3D
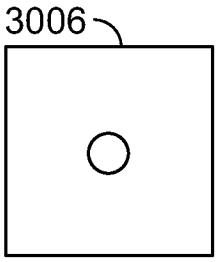
FIG. 3E
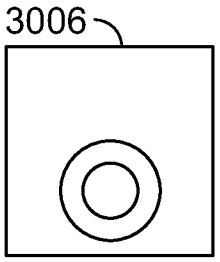
FIG. 3F
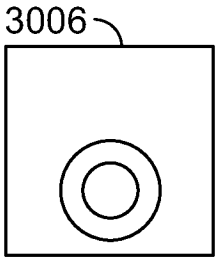
FIG. 3G
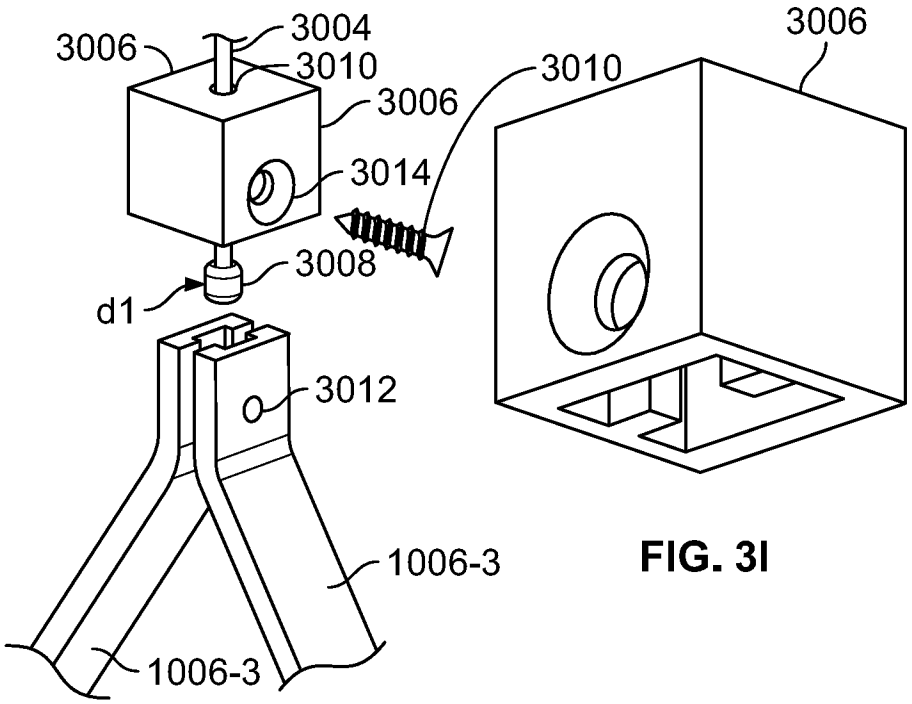
FIG. 3H
FIG. 3I

LIGHTING SYSTEM INCLUDING A TRUSS STRUCTURE OR A PLATFORM OF POWER BARS

CROSS-REFERENCE TO RELATED APPLICATION(S)

This application claims priority to U.S. Provisional Patent Application No. 62/752,648, filed on Oct. 30, 2018 in the U.S.P.T.O., the disclosure of which is incorporated by reference herein in its entirety.

TECHNICAL FIELD

The present invention relates to a lighting system, and more particularly, to a lighting system having various configurations.

DISCUSSION OF THE RELATED ART

Designing lighting for a space has always been an interesting challenge because the lighting system needs to meet utilitarian, technical and aesthetic needs. For any such endeavor to be successful, technical, architectural and artistic skills need to be combined.

Several different types of ceiling lights are presently available, including surface mounted lights, recessed lights and hanging lights disposed on tracks either attached to the ceiling or suspended below the ceiling. The first two light categories are very conventional and are disadvantageous because the positions of the lights are fixed and the configurations available for each light are very limited. Conventional track lighting provides a little more flexibility especially as far as the positions of the lights are concerned. However, because of power requirements and other factors, the number, size and shape of light fixtures that can be used in such systems is fairly limited.

SUMMARY OF THE INVENTION

Generally speaking, in accordance with the invention, a lighting system is provided that includes a platform assembly, a plurality of hangers configured to hang the platform assembly from a supporting structure, and at least one luminaire or light pendant electrically and structurally coupled to the platform for emitting light.

The platform assembly may include a plurality of first power bars spaced from one another and extending in a first direction, and a plurality of second power bars spaced from one another and extending in a second direction that crosses the first direction. The first and second power bars may be electrically and structurally connected to one another.

BRIEF DESCRIPTION OF THE DRAWINGS

The above and other features of the present invention will become more apparent by describing in detail exemplary embodiments thereof in conjunction with the accompanying drawings, in which:

FIG. 1AA is a bottom view illustrating a bar connector according to an exemplary embodiment of the present invention;

FIG. 1AB is a right view illustrating the bar connector of FIG. 1AA;

FIG. 1AC is a left view illustrating the bar connector of FIG. 1AA;

FIG. 1AD is a top view illustrating the bar connector of FIG. 1AA;

FIG. 1AE is a front view illustrating the bar connector of FIG. 1AA;

FIG. 1AF is an exploded perspective view illustrating the bar connector of FIG. 1AA;

FIG. 1AG is a perspective view illustrating the bar connector of FIG. 1AA in a parallel bar orientation;

FIG. 1AH is a perspective view illustrating the bar connector of FIG. 1AA in a perpendicular bar orientation;

FIG. 1AI is a perspective view illustrating the bar connector of FIG. 1AH;

FIG. 1AJ is a bottom view illustrating a bar connector according to an exemplary embodiment of the present invention;

FIG. 1AK is a front view illustrating the bar connector of FIG. 1AJ;

FIG. 1AL is a right view illustrating the bar connector of FIG. 1AJ;

FIG. 1AM is a top view illustrating the bar connector of FIG. 1AJ;

FIG. 1AN is an exploded perspective view illustrating the bar connector of FIG. 1AJ;

FIG. 1AO is a perspective view illustrating the bar connector of FIG. 1AJ mounted to a power bar in a parallel bar orientation;

FIG. 1AP is a perspective view illustrating the bar connector of FIG. 1AJ mounted to a power bar in a perpendicular bar orientation;

FIG. 1AQ is a perspective view illustrating the bar connector of FIG. 1AO mounted to a power bar in a perpendicular bar orientation;

FIG. 1Q is a front view illustrating the bar of FIG. 1R;

FIG. 1R is a left view illustrating a bar according to an exemplary embodiment of the present invention;

FIG. 1S is a right view illustrating the bar of FIG. 1R;

FIG. 1T is a top view illustrating the bar of FIG. 1R;

FIG. 3C is a bottom view of a hanging structure included in the lighting system of FIG. 3A according to an exemplary embodiment of the present invention;

FIG. 3D is a front view of the hanging structure of FIG. 3C;

FIG. 3E is a top view of the hanging structure of FIG. 3C;

FIG. 3F is a left view of the hanging structure of FIG. 3C;

FIG. 3G is a right view of the hanging structure of FIG. 3C;

FIG. 3H is an exploded perspective view of the hanging structure of FIG. 3C;

FIG. 3I is a magnified view of a component of the hanging structure of FIG. 3C;

DETAILED DESCRIPTION OF THE EMBODIMENTS

Figure 1A:
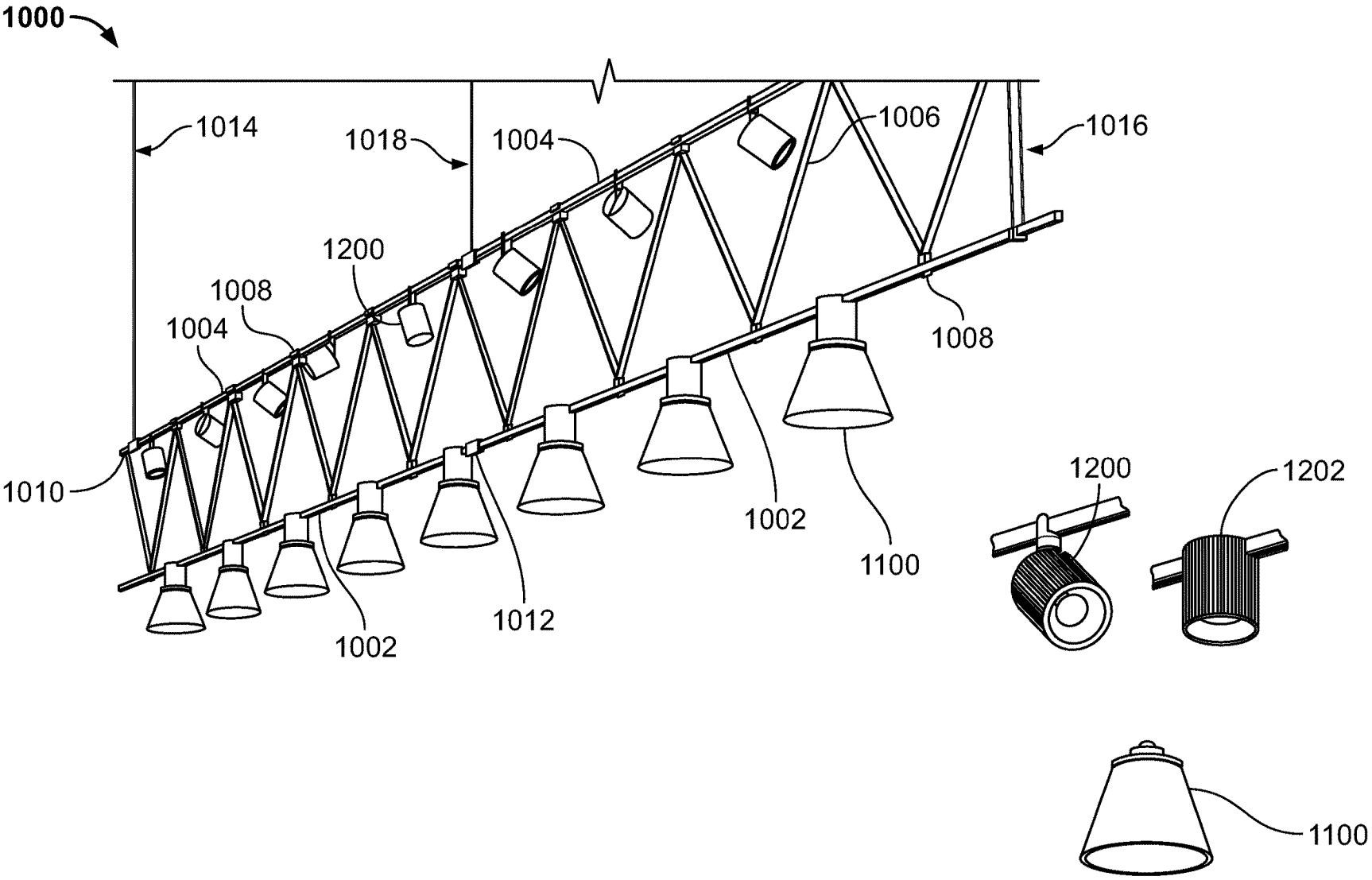
FIG. 1A is a perspective view illustrating a lighting system according to an exemplary embodiment of the present invention.

Exemplary embodiments of the present invention will be described more fully hereinafter with reference to the accompanying drawings. The present invention may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being connected to another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

FIG. 1A illustrates a lighting system 1000 according to an exemplary embodiment of the present invention. Referring to FIG. 1A, the lighting system 1000 may include a planar truss structure. Although the structure of the lighting system 1000 may be described as including a planar truss structure, it is understood that the truss structure need not be perfectly planar. For example, manufacturing variations, the weight of the truss structure itself, the weight of luminaires coupled to the truss structure, and/or other external forces acting on the truss structure may cause the truss structure to deflect (e.g., bend, twist, warp, etc.) such that it may not be perfectly planar.

Referring to FIG. 1A, the lighting system 1000 may include a plurality of first (e.g., lower) power bars 1002, a plurality of second (e.g., upper) power bars 1004, a plurality of bars 1006, a plurality of bar connectors 1008, a plurality of bar connectors 1010, one or more power bar connectors 1012, at least one hanger 1014, a power supply member 1016, a plurality of luminaires 1100, a plurality of luminaires 1200, and at least one hanger 1018.

As shown in FIG. 1A, the first and second power bars 1002 and 1004, together with the bars 1006 and the bar connectors 1008 and 1010, form a substantially planar truss structure. The substantially planar truss structure is a graceful structure which is strong and light, and provides both structural support and electrical supply to the luminaires 1100 and 1200.

FIG. 1A illustrates a truss structure containing two power bars 1002 and two power bars 1004 respectively joined together by the power bar connector 1012 and hanger 1018. In other words, the power bars 1002 and 1004 may be joined together to form an extended (e.g., modular) truss.

Figures 1B, 1O, 1P:
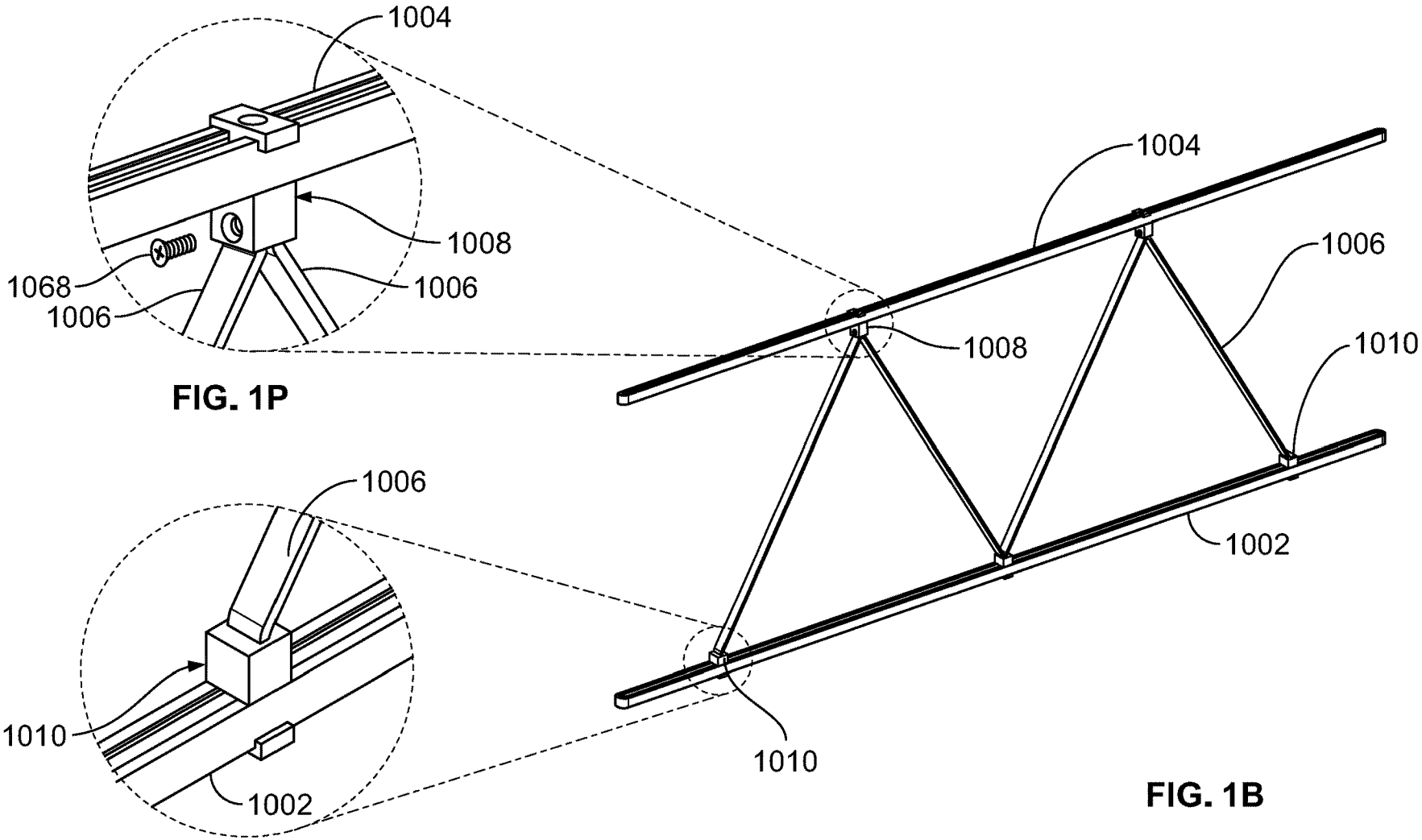
FIG. 1B is a perspective view illustrating a lighting system according to an exemplary embodiment of the present invention.
FIG. 1O is a magnified view illustrating a first portion of the lighting system of FIG. 1B.
FIG. 1P is a magnified view illustrating a second; portion of the lighting system of FIG. 1B.
Figure 1C:
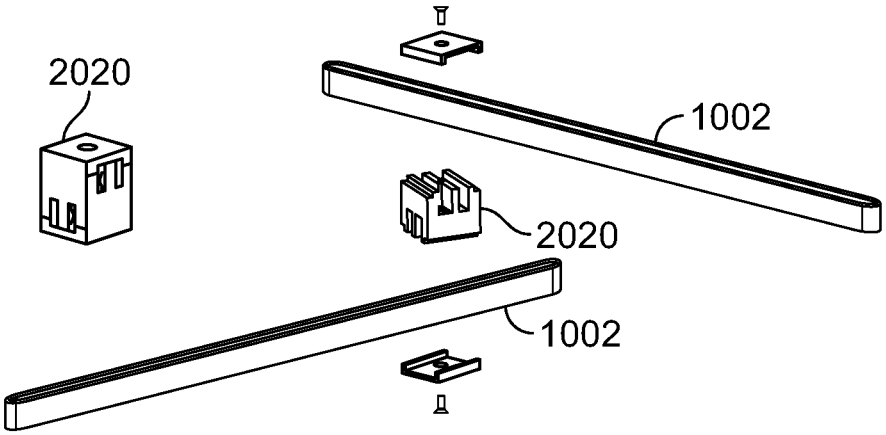
FIG. 1C is an exploded perspective view illustrating two power bars and a bar mount according to an exemplary embodiment of the present invention.

FIG. 1B illustrates an exemplary lighting system including a single truss structure. A plurality of single truss structures such as that of FIG. 1B may be joined together to form a modular truss structure of a desired length. For example, the truss structure of FIG. 1A may be made of two single structures such as that shown in FIG. 1B, with the two single structures joined to one another via the power bar connector 1012 and the hanger 1018.

Each of the power bars 1002 and 1004 may be a structural member of the truss as well as an electrical conducting member which may be used to supply electrical power to all of the luminaires 1100 and 1200 (or to other luminaires that may be coupled to the lighting system 1000), and to supply electrical power to an adjacent power bar 1002 or 1004, respectively, via the connector 1012 and hanger 1018.

FIGS. 1C-1F and 1H-1L illustrate a plurality of power bars 1002 according to exemplary embodiments of the present invention. The power bars 1004 may have a structural and electrical configuration that is identical to the power bars 1002. Thus, only the configuration of the power bars 1002 may be described below.

As shown in FIGS. 1C-1F and 1H-1L, a power bar 1002 may be an elongate member having a predefined length. In other words, the power bar 1002 may be manufactured at a desired length. Referring to FIGS. 1H-1L, the power bar 1002 may include a first longitudinal component 1020, a second longitudinal component 1022, and a cap 1024 at either end of the first and second longitudinal components 1020 and 1022.

Figure 1D:
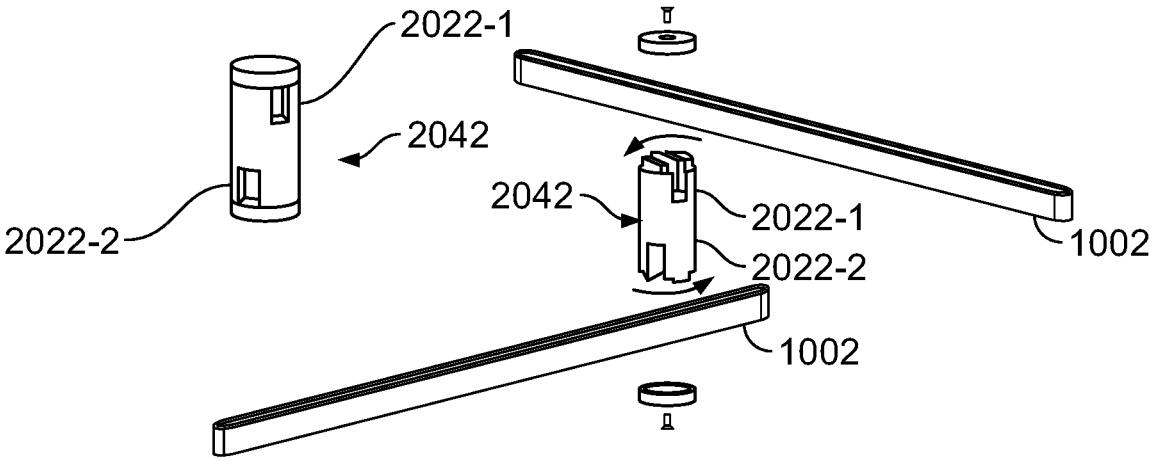
FIG. 1D is an exploded perspective view illustrating two power bars and a bar mount according to an exemplary embodiment of the present invention.
Figure 1E:
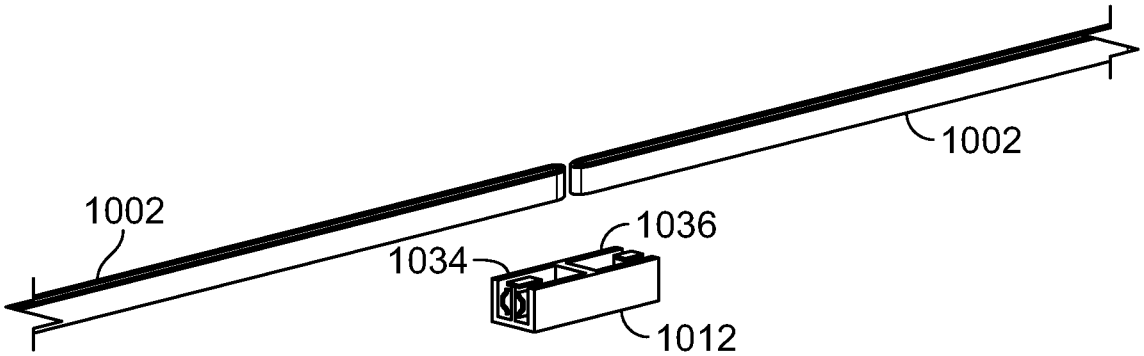
FIG. 1E is an exploded perspective view illustrating two power bars and a power bar connector according to an exemplary embodiment of the present invention.
Figure 1F:
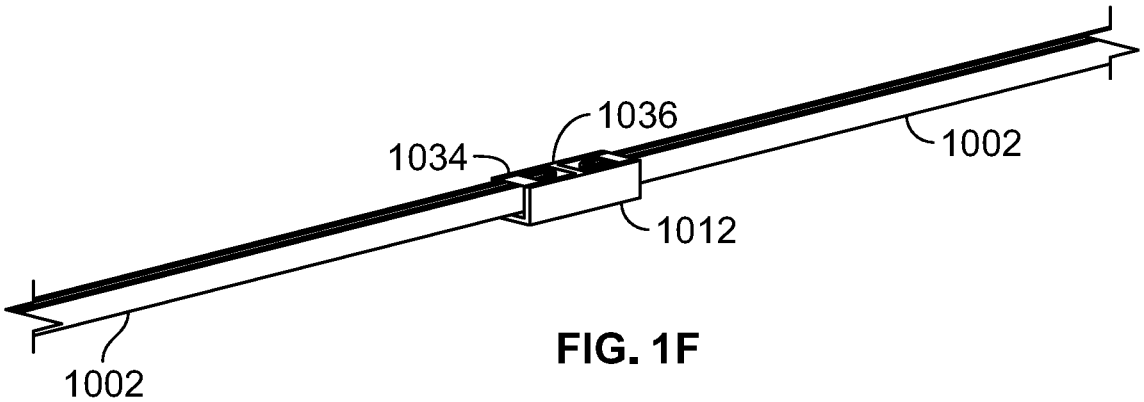
FIG. 1F is a perspective view illustrating two power bars and a power bar connector according to an exemplary embodiment of the present invention in a coupled state.
Figure 1G:
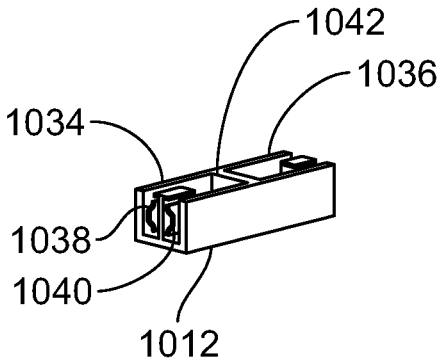
FIG. 1G is a perspective view illustrating the power bar connector of FIGS. 1E and 1F.
Figure 1H:
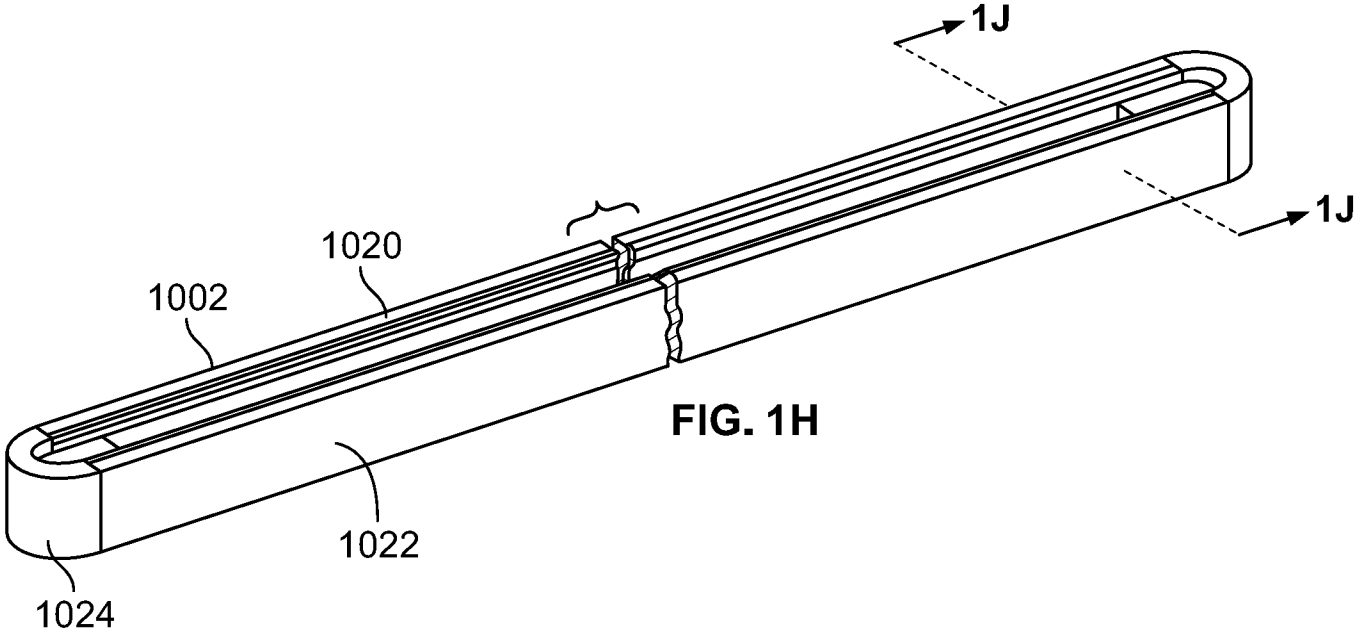
FIG. 1H is a perspective view illustrating a power bar according to an exemplary embodiment of the present invention.
Figure 1I:
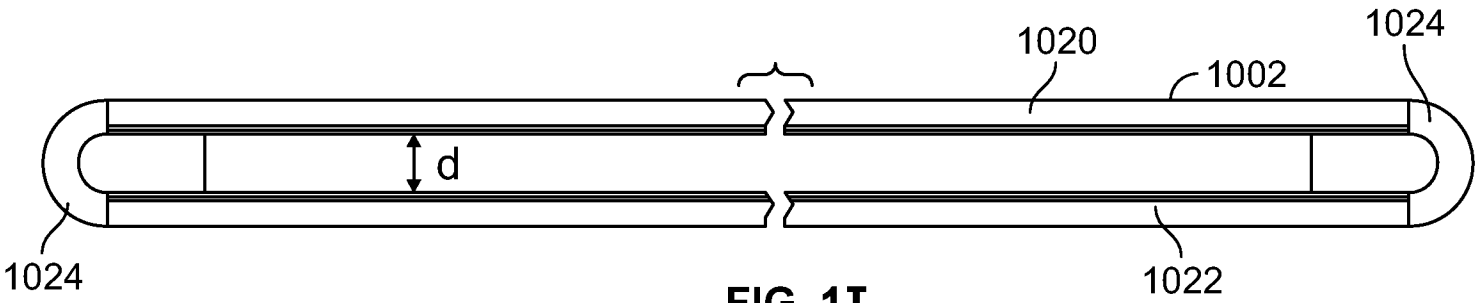
FIG. 1I is a top view illustrating the power bar of FIG. 1H.
Figure 1K:
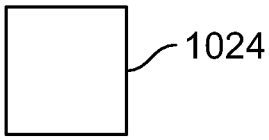
FIG. 1K is an end view of the power bar of FIG. 1H.
Figure 1J:
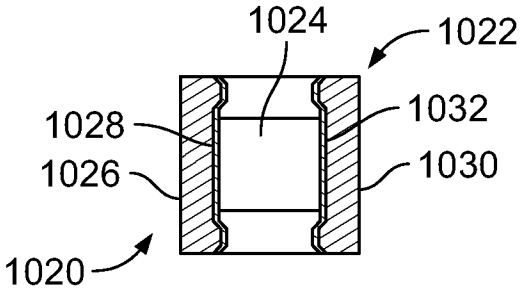
FIG. 1J is a cross sectional cut taken along line 1J-1J of FIG. 1H.
Figure 1L:
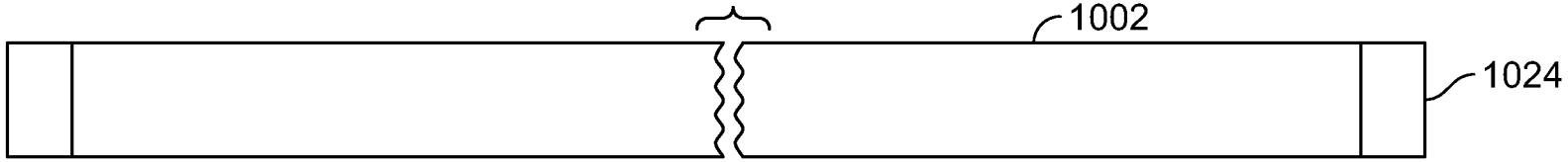
FIG. 1L is a side view of the power bar of FIG. 1H.

Referring to FIG. 1J, the first longitudinal component 1020 may include a first insulating rail 1026 and a first electrically conducting rail 1028. Referring to FIG. 1J, the second longitudinal component 1022 may include a second insulating rail 1030 and a second electrically conducting rail 1032. Thus, the first and second electrically conducting rails 1028 and 1032 are disposed inside of the power bar 1002, with the outside of the power bar 1002 being electrically insulated from the first and second electrically conducting rails 1028 and 1032.

The first and second electrically conducting rails 1028 and 1032 (or first and second rails 1028 and 1032 for brevity purposes) are configured to transmit electrical power from the power supply member 1016 to the luminaires of the electrical system 1000 (e.g., the luminaires 1100, 1200, etc.) as well as to adjacent power bars 1002 through either the power bar connector 1012 or the hanger 1018. Thus, the first and second electrically conducting rails 1028 and 1032 may be made of a conducting material, for example, copper, aluminum, etc.

The first and second longitudinal components 1020 and 1022 may be spaced apart from one another by a predetermined distance "d", as shown in FIG. 1I.

Referring to FIG. 1G, the power bar connector 1012 may include a first portion 1034 and a second portion 1036. The power bar connector 1012 may be configured to structurally and electrically connect two power bars 1002 to one another, as shown in FIGS. 1E and 1F. Referring to FIGS. 1E and 1F, the first portion 1034 of the power bar connector 1012 is configured to be selectively structurally and electrically coupled to an end of one of the power bars 1002, and the second portion 1036 of the power bar connector 1012 is configured to be selectively structurally and electrically coupled to an end of the other power bar 1002.

As shown in FIG. 1G, the first portion 1034 may include a first electrical contact 1038 and a second electrical contact 1040. Although not shown in FIG. 1G, the second portion 1036 of the power bar connector 1012 may also include a first electrical contact 1038 and a second electrical contact 1040 as well, similar to the first portion 1034.

In the power bar connector 1012, the pair of first electrical contacts 1038 may be electrically connected to one another (e.g., through internal wiring in the power bar connector 1012 not shown in FIG. 1G), and the pair of second electrical contacts 1040 may also be electrically connected to one another.

When a pair of power bars 1002 are connected to the power bar connector 1012 as shown in FIG. 1G, the first and second electrically conducting rails 1028 and 1032 of one of the power bars 1002 are respectively electrically connected to the first and second electrical contacts 1038 and 1040 of the first portion 1034 of the power bar connector 1012, and the first and second electrically conducting rails 1028 and 1032 of the other power bar 1002 are respectively electrically connected to the first and second electrical contacts 1038 and 1040 of the second portion 1036 of the power bar connector 1012. Thus, the power bar connector 1012 may electrically connect the first conducting rails 1028 of a pair of adjacent power bars 1002 to one another as well as the second conducting rails 1032 of the pair of adjacent power bars 1002 to one another. In other words, the power bar connector 1012 may electrically connect the pair of power bars 1002 to one another.

The hanger 1018 may have a similar configuration to that of the power bar connector 1012 of FIG. 1G, but the hanger 1018 may also include a cable connected to the power bar connector for structurally supporting the lighting system 1000 from a ceiling or other supporting structure. In other words, the cable of the hanger 1018 may be used for hanging the lighting system 1000 from the ceiling. In an embodiment, the cable of the hanger 1018 may be connected to, for example, a middle wall section 1042 (see FIG. 1G) of the power bar connector.

Referring to FIG. 1A, the hanger 1014 may be disposed at an end portion of the lighting system 1000. The hanger 1014 does not join two power bars 1002 to one another, but the hanger 1014 is used for hanging (e.g., structurally supporting) an end portion of the lighting system 1000 or for supporting the lighting system 1000 at any other point along its length. The hanger 1014 may have a structure similar to that of the hanger 1018, but the hanger 1014 omits the middle wall section 1042. Thus, the entire hanger 1014 can be inserted within a power bar for supporting the power bar, and in turn, the truss structure since the power bar is a component of the truss. In addition, the hanger 1014 may omit the electrical contacts 1038 and 1040 since the hanger 1014 need not electrically connect two power bars 1002 to one another, and for mainlining the cable of the hanger 1014 electrically insulated from the power bar 1002.

Figure 1M:
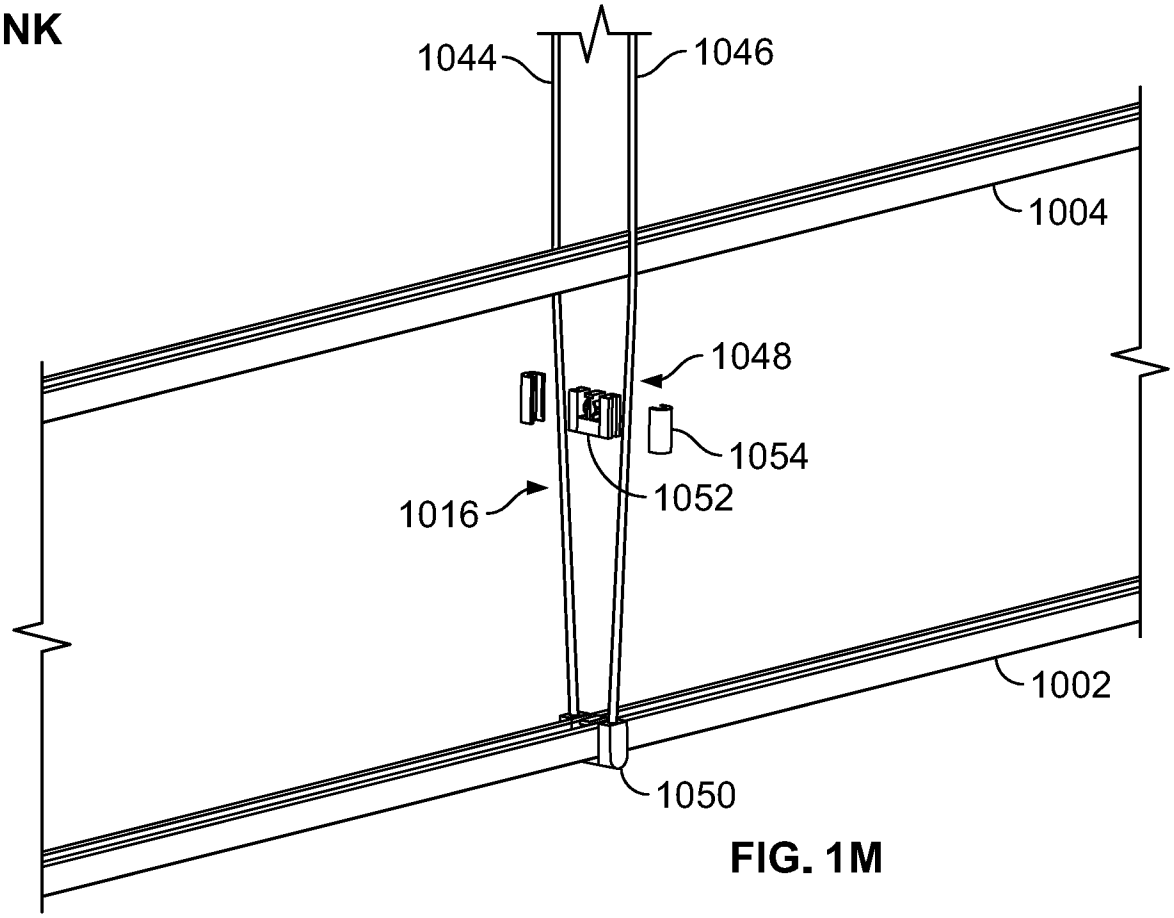
FIG. 1M is a partially exploded view illustrating a power supply member according to an exemplary embodiment of the present invention.

The power supply member 1016 may be configured to transmit electrical power from an exterior power supply source (e.g., the building's power grid, a generator, etc.) to the power beams 1002 and 1004. Referring to FIG. 1M, the power supply member 1016 may include a first cable, rod, wire, etc. (collectively "cable") 1044, a second cable 1046, a first power connector 1048, and a second power connector 1050.

The first and second cables 1044 and 1046 may be configured to transmit AC or DC current to the power beams 1002 and 1004, depending on the configuration of the luminaires 1100 and 1200. One of the first and second cables 1044 and 1046 may transmit one polarity of the voltage, and the other of the first and second cables 1044 and 1046 may transmit the other polarity of the voltage, whether the voltage is AC or DC. Merely as an example, the first cable 1044 may supply positive (+) DC voltage, while the second cable 1046 may supply negative (−) DC voltage.

Referring to FIG. 1M, the first power connector 1048 may be configured to transmit electrical power from the first and second cables 1044 and 1046 to the power bar 1004. The second power connector 1050 may be configured to transmit electrical power from the first and second cables 1044 and 1046 to the power bar 1002.

Figure 1N:
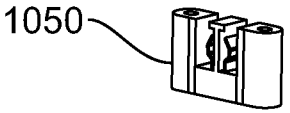
FIG. 1NK is a magnified view of the second power connector of the power supply member of FIG. 1M.
Figure 1W:
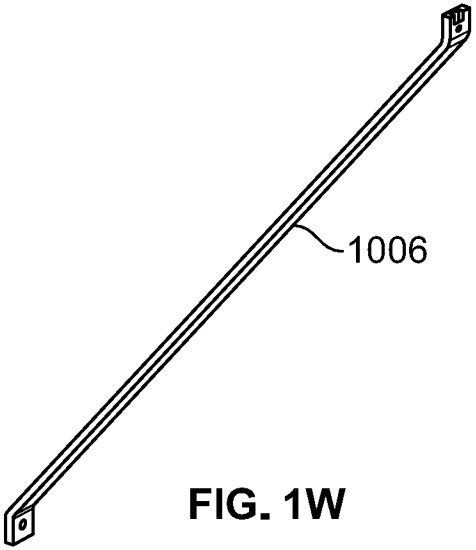
FIG. 1W is a perspective view the bar of FIG. 1R.

As more clearly illustrated in FIG. 1NK, the second power connector 1050 may include first and second electrical contacts 1038-1 and 1038-2 for transmitting electrical power from the first and second power cables 1044 and 1046 to the second power bar 1002. Referring to FIG. 1M, the first power connector 1048 may have a middle portion 1052 for electrically connecting the first and second power cables 1044 and 1046 with the power bar 1004 (similar to the second power connector 1050), and side connectors 1054 that are selectively coupleable to the middle portion 1052 via selective coupling mechanisms such as a screw, adhesive, etc.

Thus, the power supply member 1016 may supply electrical power to each level of the electrical system 1000 (e.g., to the top level defined by the power bars 1004 and to the bottom level defined by the power bars 1002) since the power supply member 1016 supplies electrical power to the power bars 1002 and 1004. In addition, since the power bar connector 1012 and hanger 1018 respectively transmit electricity between adjacent power bars 1002 and 1004, a single power supply member 1016 can supply electrical power to the entire lighting system 1000, regardless of the length of the lighting system 1000 and regardless of the number of components (e.g., the number of power bars 1002 and 1004) forming the lighting system 1000.

In addition, the power supply member 1016 is also a structural component which may be used for hanging the lighting system 1000 from the ceiling. As shown in FIG. 1A, the power supply member 1016 acts as one of the three hangers (the other hangers being 1014 and 1018) of the lighting system 1000. Thus, the same power supply member 1016 may perform both as a hanger and as a power supply source for the lighting system 1000. The cables of the hangers 1014 and 1018 may be used for supporting the weight of the lighting system 1000. However, the cables of the hangers 1014 and 1018 may be electrically insulated from the lighting system 1000. In other words, the hangers 1014 and 1018 are nonconducting.

The bars 1006 may be structural components of the lighting system 1000. The bars 1006, together with the power bars 1002 and 1004 form the substantially planar truss structure of the lighting system 1000. The bars 1006 may be made of a metal, a polymer (e.g., plastic such as polycarbonate, etc.) wood, etc. Merely as an example, the bars 1006 may be made of aluminum, steel, etc., for strength, durability and rigidity.

Figure 1V:
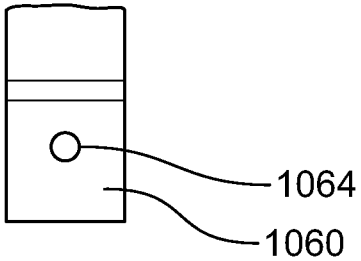
FIG. 1V is a magnified view of a second end of the bar of FIG. 1R.
Figure 1U:
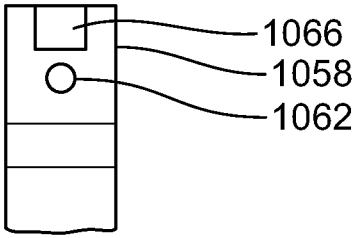
FIG. 1U is a magnified view of a first end of the bar of FIG. 1R.

An exemplary bar 1006 is illustrated in FIGS. 1Q-1W. The bar 1006 may have an elongate portion 1056, a first end portion 1058 and a second end portion 1060. The end portions 1058 and 1060 may extend at an angle with respect to the elongate portion 1056. For example, the ends 1056 and 1058 may be bent from the elongate portion 1056. As shown in FIGS. 1V and 1U, each of the end portions 1058 and 1060 may have a through hole 1062 and 1064. The end portion 1058 may also have a cutout 1066 for wire swage.

The bars 1006 may be connected to the power bars 1002 and 1004 in the configuration shown in FIGS. 1A and 1B via the bar connectors 1008 and 1010.

With reference to FIGS. 1B and 1P, a bar connector 1008 may be configured to structurally couple two bars 1006 to a power bar 1004 and to a power bar 1002 (the power bar 1004 is shown in FIG. 1P for convenience of illustration). FIG. 1O is a magnified view illustrating a first portion of the lighting system of FIG. 1B. FIG. 1P is a magnified view illustrating a second; portion of the lighting system of FIG. 1B.

Referring to FIG. 1P, the ends portions 1058 (or the end portions 1060) of a pair of bars 1006 may be coupled to a bar connector 1008. The bar connector 1008 may be coupled to the power bar 1004, and a screw 1068 may be used to couple the pair of bars 1006 to the bar connector 1008.

FIGS. 1AA-1AI illustrate a bar connector 1008 according to an exemplary embodiment.

Referring to FIGS. 1AA-1AI, the bar connector 1008 may include a first portion 1008-1 configured to receive the ends 1058 and/or 1060 of the pair of bars 1006, a second portion 1008-2 configured to be inserted between the first and second longitudinal components 1020 and 1022 of the power bar 1004 (or 1002), and a cap 1008-3.

Referring to FIG. 1AA, the first portion 1008-1 may include an "H" shaped cavity therein for receiving the ends 1058 and/or 1060 of the pair of bars 1006. Referring to FIG. 1AF, a screw 1068 may be inserted through a hole 1072 of the first portion 1008-1, and through the holes 1062 of the bars 1006 in order to selectively couple the bars 1006 to the bar connector 1008. The holes 1062 may be threaded in order to increase the strength of the connection with the screw 1068, and to prevent the bars 1006 from becoming disengaged with the screw 1068. The screw 1068 may alternatively be replaced by a nut and bolt (not shown), the bolt extending through the entire length of the bar connector 1008 with the nut coupled to the end of the bolt that protrudes beyond the bar connector 1008.

Referring to FIGS. 1AA-1AI, the cap 1008-3 may be disposed on the power bar 1004 (see FIG. 1AF), and a screw 1070 may be inserted through a hole 1074 and through a hole 1076 (see FIG. 1AF) in order to couple the bar connector 1008 with the power bar 1004.

FIG. 1AG is a perspective view illustrating the bar connector of FIG. 1AA in a parallel bar orientation. In other words, the pair of bars 1006 may be connected to the bar connector 1008 of FIG. 1AG in such a way that the two bars 1006 extend parallel to the direction of the power bar 1002 (of course, at an angle with respect to the power bar 1002).

FIG. 1AH is a perspective view illustrating the bar connector of FIG. 1AA in a perpendicular bar orientation. In other words, the pair of bars 1006 may be connected to the bar connector 1008 of FIG. 1AH in such a way that the two bars 1006 extend perpendicular to the direction of the power bar 1002 (of course, at an angle with respect to the power bar 1002).

With reference to FIGS. 1AJ-1AP, a bar connector 1010 may be configured to structurally couple one bar 1006 to a power bar 1004 and to a power bar 1002 (the power bar 1004 is shown in FIG. 1AN for convenience of illustration).

The bar connector 1010 may be similar to the bar connector 1008 with the exception that the bar connector 1010 is configured to receive the end portion 1058 or 1060 of only one bar 1006. Thus, instead of the "H"-shaped opening 1076 of the bar connector 1008, the bar connector 1010 has a single bar-shaped opening 1078 (see FIGS. 1AJ-1AP). All the other components of the bar connector 1010, for example, components 1010-1 to 1010-3, screws 1068-1 and 1070-1 of FIGS. 1AJ-1AP, may be assumed to be similar or the same as their respective counterparts 1008-1 to 1008-3, 1068 and 1010. Thus, a detailed description thereof will be omitted for brevity purposes. Each of the bar connectors 1010 may be disposed at a respective end of the truss structure, as shown in FIG. 1B.

FIG. 1AO is a perspective view illustrating the bar connector of FIG. 1AJ mounted to a power bar in a parallel bar orientation. In other words, the bar 1006 may be connected to the bar connector 1010 of FIG. 1AO in such a way that the bar 1006 extends parallel to the direction of the power bar 1002 (of course, at an angle with respect to the power bar 1002). FIG. 1AP is a perspective view illustrating the bar connector of FIG. 1AJ mounted to a power bar in a perpendicular bar orientation. In other words, the bar 1006 may be connected to the bar connector 1010 of FIG. 1AP in such a way that the bar 1006 extends parallel to the direction of the power bar 1002 (of course, at an angle with respect to the power bar 1002). See the different orientation of the openings 1078 of the bar connector 1010 of FIG. 1AP and the bar connector 1010 of FIG. 1AO.

The bar connectors 1008 and 1010 may be electrically insulated from the power bars 1002 and 1004. Thus, the bar connectors 1008 and 1010 electrically insulate the bars 1006 from the power bars 1002 and 1004. Accordingly, the bars 1006 serve as structural components of the lighting system 1000, but not as electrical components thereof. The bars 1006 increase the strength and rigidity of the lighting system 1000. When the bars 1006 are made of a strong and lightweight material such as aluminum, the bars 1006 contribute to reducing the weight of the lighting system 1000 while providing ample structural strength.

The bar connectors 1008 and 1010 and the bars 1006, may be assembled in the field since they can be coupled together with the screws 1068 and 1070. Accordingly, the lighting system 1000 can be quickly and efficiently installed in the field. Due to its truss structure, the lighting system 1000 is visually graceful and structurally strong and light. In addition, since the lighting system 1000 is structurally configured as a truss, the lighting system 1000 can be made to be very long, and may be fed with electrical power by a single power supply member 1016. Thus, the lighting system 1000 has a structurally and electrically efficient frame because the frame is both an electrical and a structural component.

In addition, since each of the power bars 1002 and 1004 is powered with electricity by the power supply member 1016, the lighting system 1000 can have two levels of lights. For example, as shown in FIG. 1A, a plurality of luminaires 1100 may be electrically connected to the power bars 1002 at the bottom elevation of the truss structure, and a plurality of luminaires 1200 may be electrically connected to the power bars 1004 at the top elevation of the truss structure. In addition, the luminaires 1100 and 1200 may be different from one another, as needed for lighting needs. For example, the luminaires 1100 may be downwardly-oriented light structures, while the luminaires 1200 may be rotatably adjustable with respect to the power bars 1004 in order to direct light at a desired location from the power bars 1004. The luminaires 1200 may be selectively adjustable in 360 degrees. It is understood that additional luminaries may be coupled to the lighting system 1000. Regardless of the configuration of a luminaire, in order for the luminaire to be coupled to the lighting system 1000, the luminaire must include a base that is configured to be structurally and electrically coupleable with the power bars 1002 and 1004.

Figure 1Y:
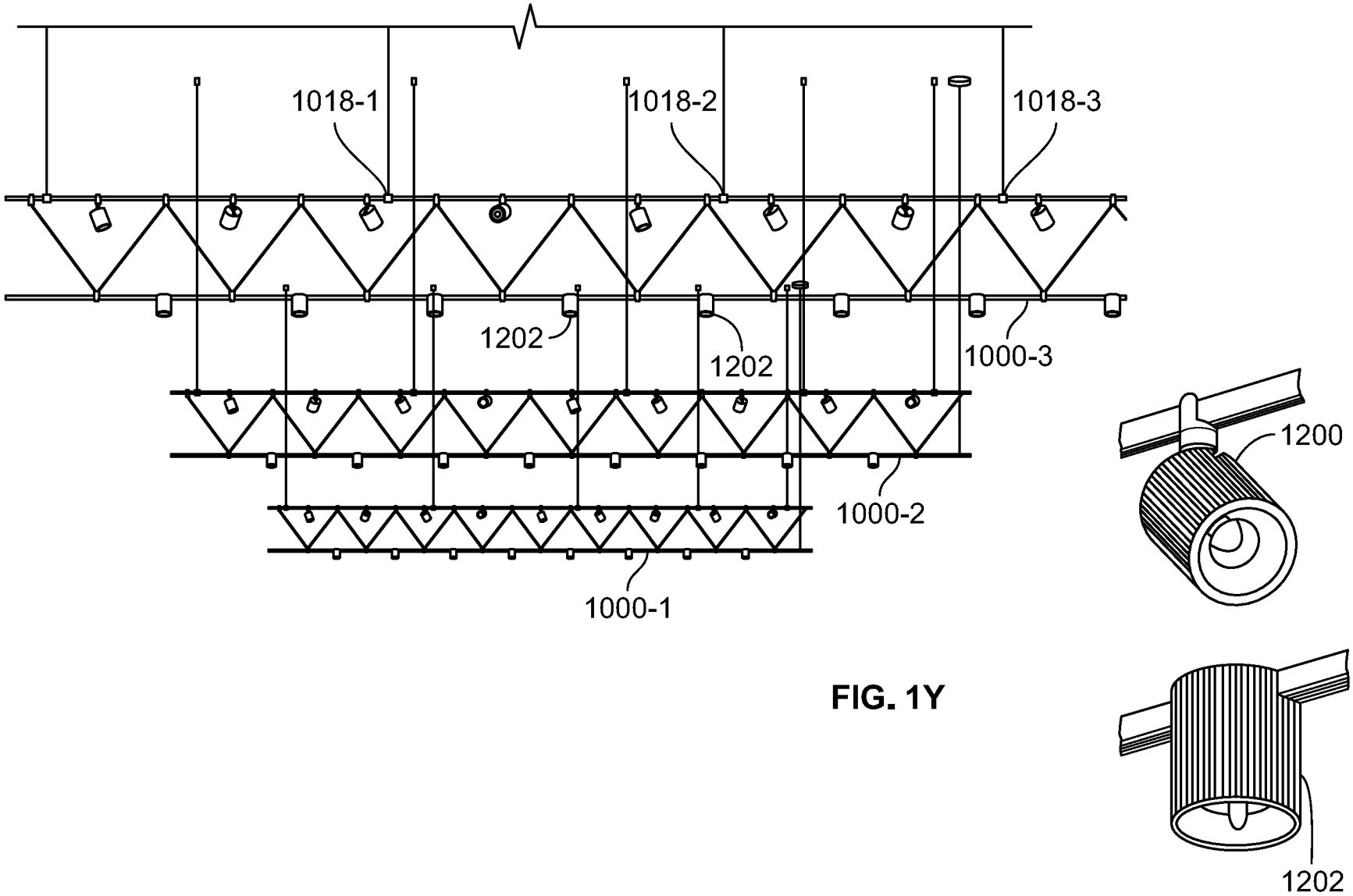
FIG. 1Y illustrates a plurality of lighting systems according to exemplary embodiments of the present invention.
Figure 1A:
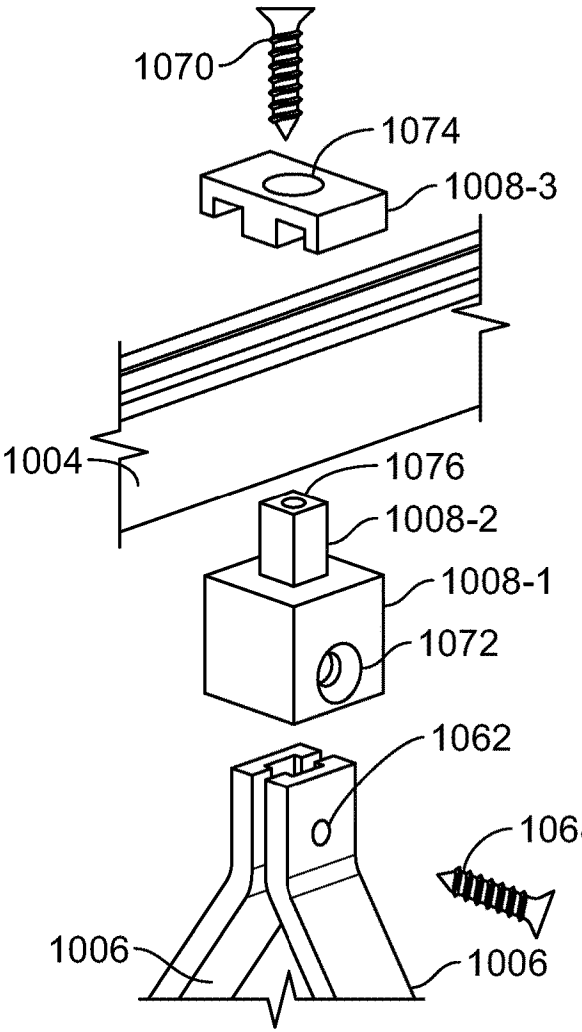
Figure 1A:
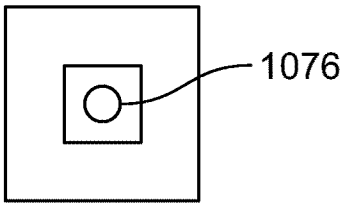
Figure 1A:
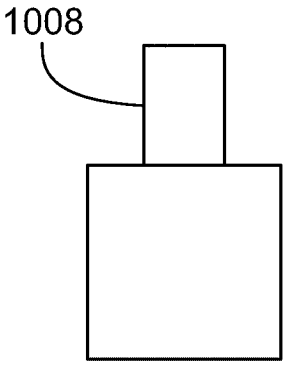
Figure 1A:
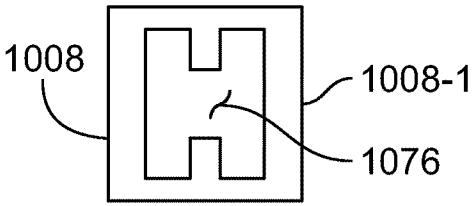
Figure 1A:
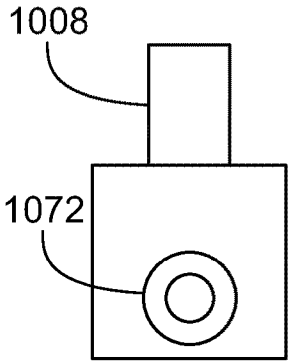
Figure 1A:
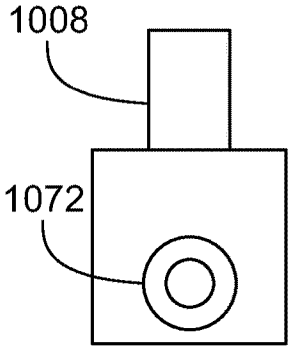
Figure 1A:
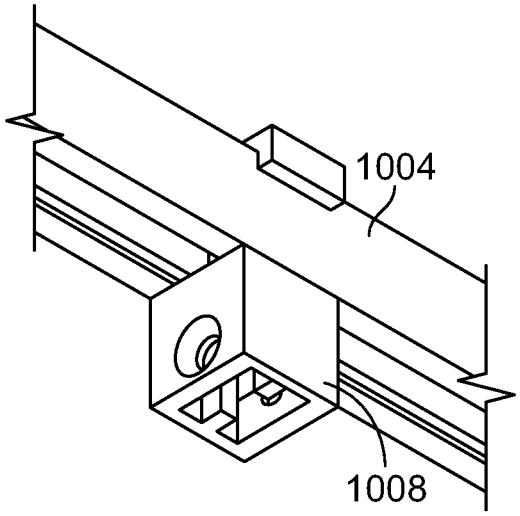
Figure 1A:
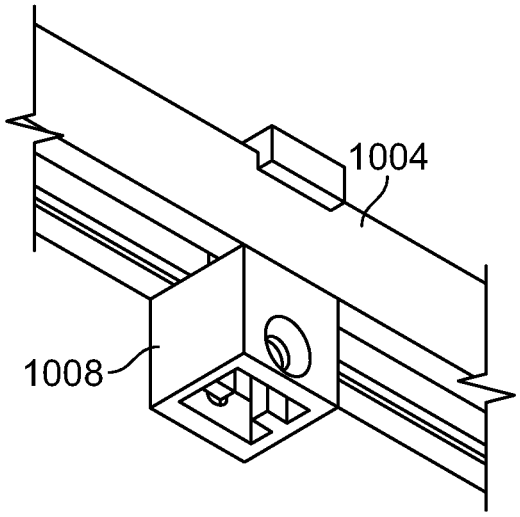
Figure 1A:
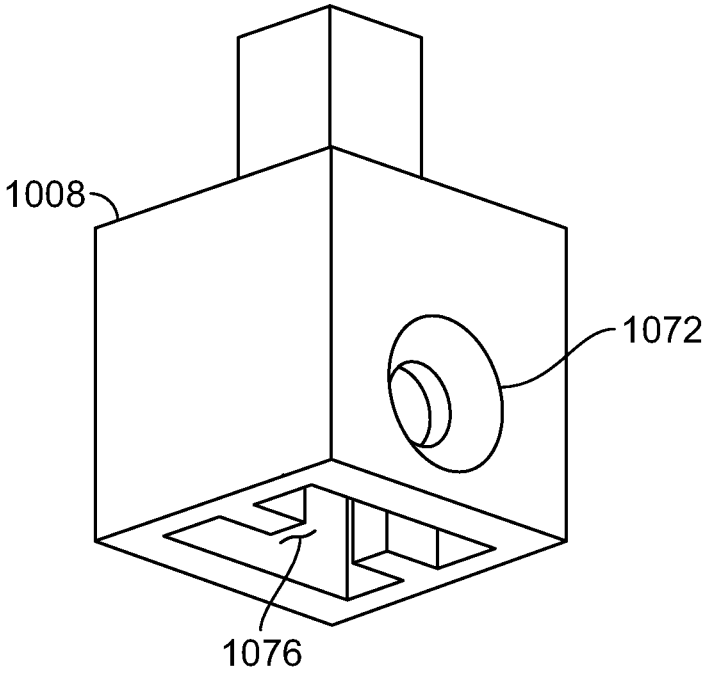
Figure 1A:
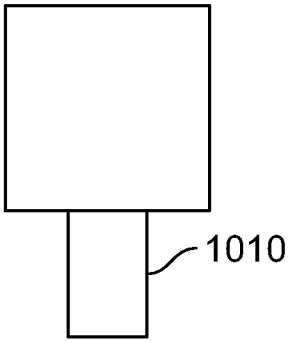
Figure 1A:
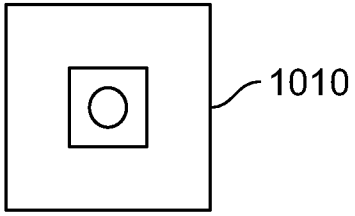
Figure 1A:
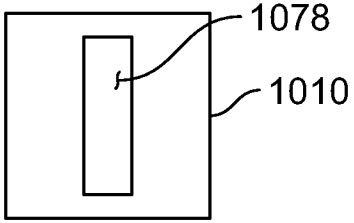
Figure 1A:
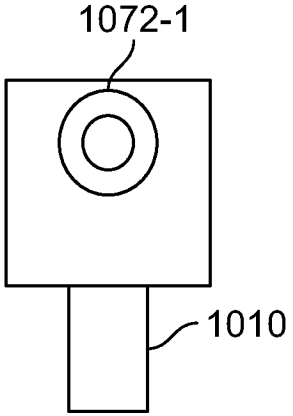
Figure 1A:
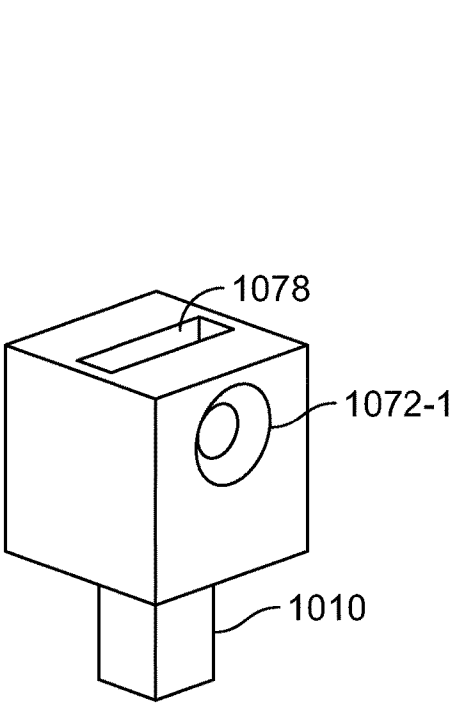
Figure 1A:
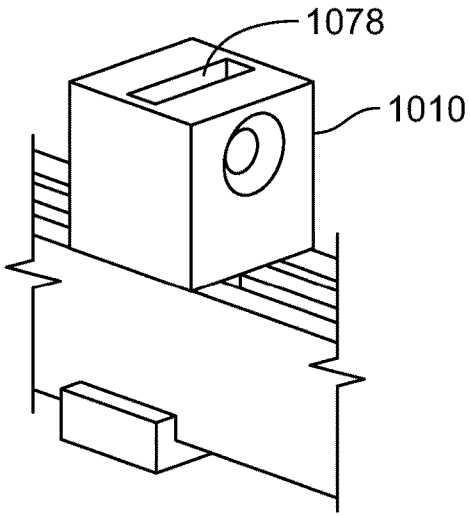
Figure 1A:
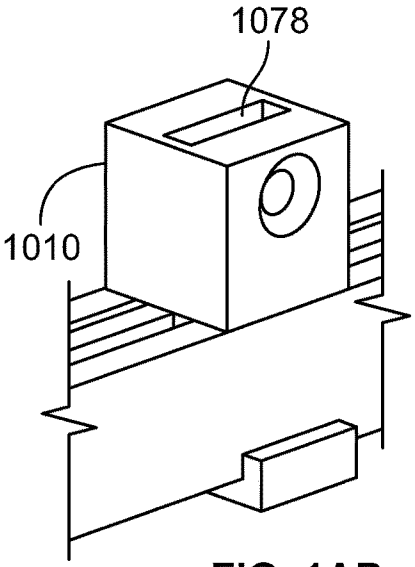
Figure 1A:
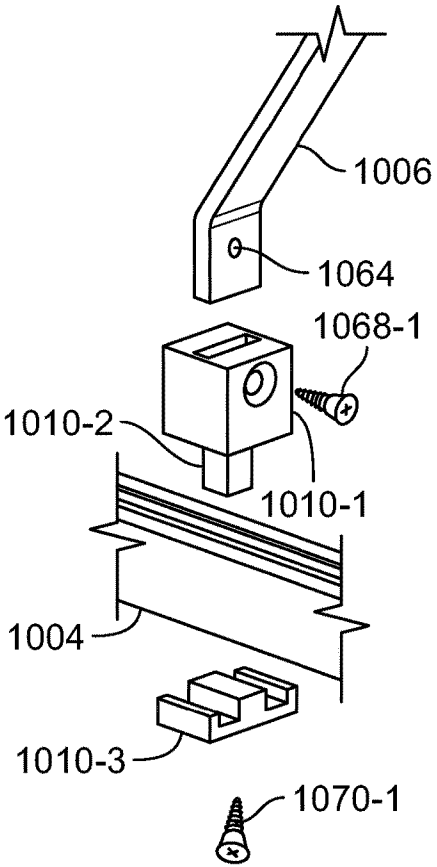

FIG. 1Y illustrates three lighting systems 1000-1 to 1000-3 spanning the entire width of a certain room. Each of the lighting systems 1000-1 to 1000-3 may be similar to the lighting system 1000. However, each of the lighting systems 1000-1 to 1000-3 may be made of four modular sections such as that shown in FIG. 1B. See FIG. 1Y illustrating the three hangers 1018-1, 1018-2, and 1018-3, connecting the four modular sections together. FIG. 1Y illustrates luminaires 1202, which are fixed to point light downwardly.

While FIGS. 1A-1Y illustrate that the lighting systems 1000 and 1000-1 to 100-3 can be configured to resemble a Pratt type of truss, it is readily apparent that the truss structure of these lighting systems can be variously modified as needed.

In addition, while the lighting systems 1000 and 1000-1 to 100-3 are described as being modular, the lighting systems 1000 and 1000-1 to 100-3 may also be made of power bars that span the entire length of the respective lighting system. In this case, the power bar connectors 1012 are not needed because the power bars 1002 and 1004 would span the entire length of the lighting system.

FIGS. 2A-2I illustrate lighting system 2000 according to an exemplary embodiment of the present invention. The lighting system 2000 may include a space frame truss structure.

Figure 2A:
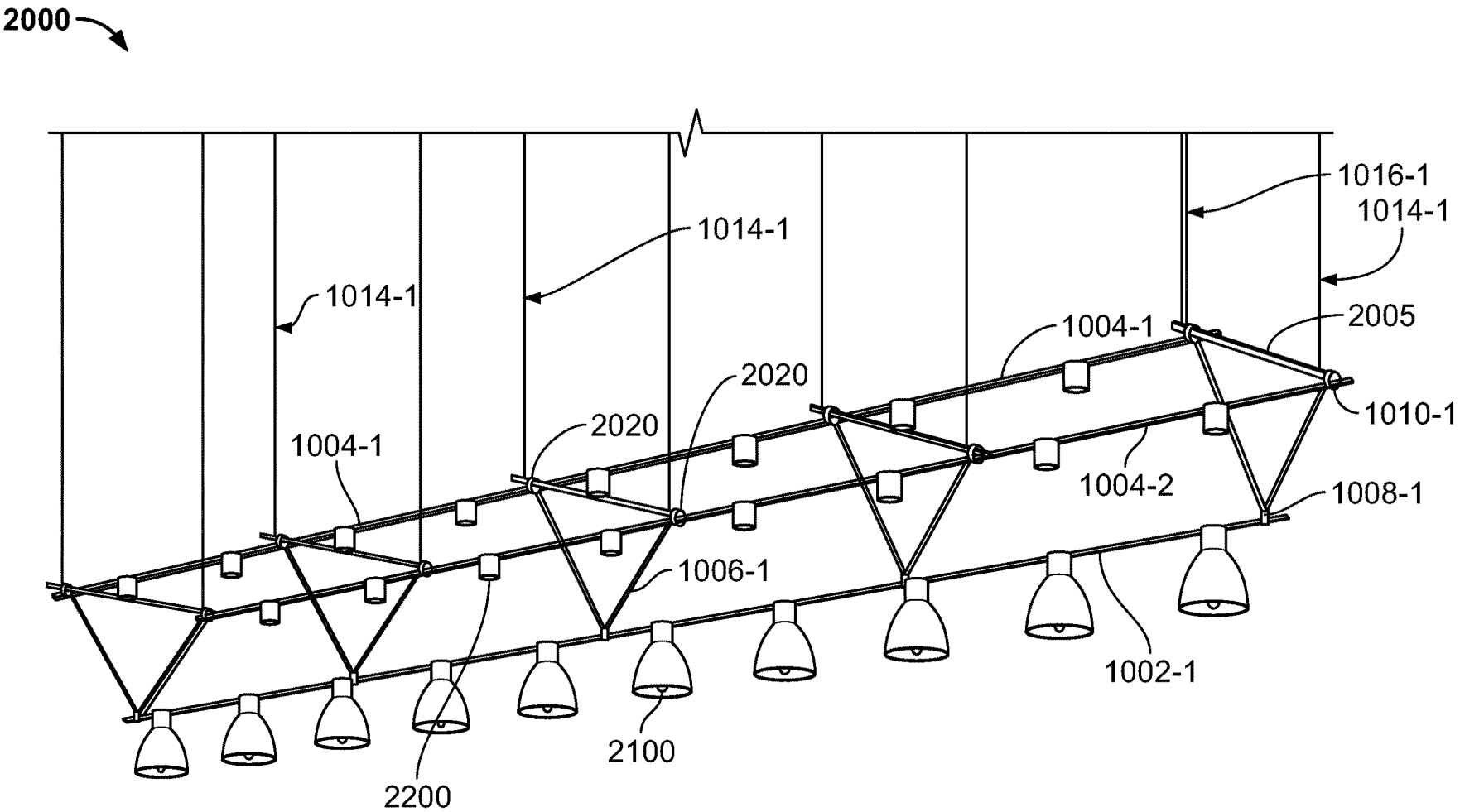
FIG. 2A is a perspective view illustrating a lighting system according to an exemplary embodiment of the present invention.

Referring to FIG. 2A, the lighting system 2000 may include a power bar 1002-1, a power bar 1004-1, a power bar 1004-2, a plurality of power bars 2005, a plurality of bar mounts 2020, a plurality of bars 1006-1, a plurality of bar connectors 1008-1, a plurality of bar connectors 1010-2, a plurality of hangers 1014-1, a power supply member 1016-1, a plurality of luminaires 2100 and a plurality of luminaires 2200.

Components of the lighting system 2000 that are not described in detail may be assumed to be similar to or the same as corresponding components described elsewhere in the specification. For example, the components 1006-1 may be identical to the bars 1006 described above, and the bar connectors 1008-1 and 1010-1 respectively may be identical to the bar connectors 1008 and 1010. A duplicate description of these components will be omitted for brevity purposes.

The power bars 1002-1, 1004-1 and 1004-2 of the lighting system 2000 may span the entire length of the lighting system 2000.

Referring to FIG. 2A, the power bars 1004-1 and 1004-2 may be spaced apart from one another, and may extend substantially parallel to one another. The plurality of power bars 2005 may be arranged along the length of the power bars 1004-1 and 1004-2. Each of the power bars 2005 may extend from the power bar 1004-1 to the power bar 1004-2. For example, each power bar 2005 may extend substantially perpendicularly to the power bars 1004-1 and 1004-2. Each power bar 2005 may be structurally and electrically connected to the power bars 1004-1 and 1004-2 through a pair of bar mounts 2020. Each bar mount 2020 may be flush with the two power bars that it is coupled to.

The connection between a power bar 2005 and the power bar 2004-1 through a bar mount 2020 is illustrated in FIGS. 2B-2G. Referring to FIGS. 2B-2G, the bar mount 2020 may include a first portion 2022 and a second portion 2024. The first portion 2022 is configured to receive the power bar 2005 therein in order to electrically and structurally connect the power bar 2005 to the bar mount 2020. Similarly, the second portion 2020 is configured to receive the power bar 2004-1 therein in order to electrically and structurally connect the power bar 2004-1 to the bar mount 2020.

Figure 2B:
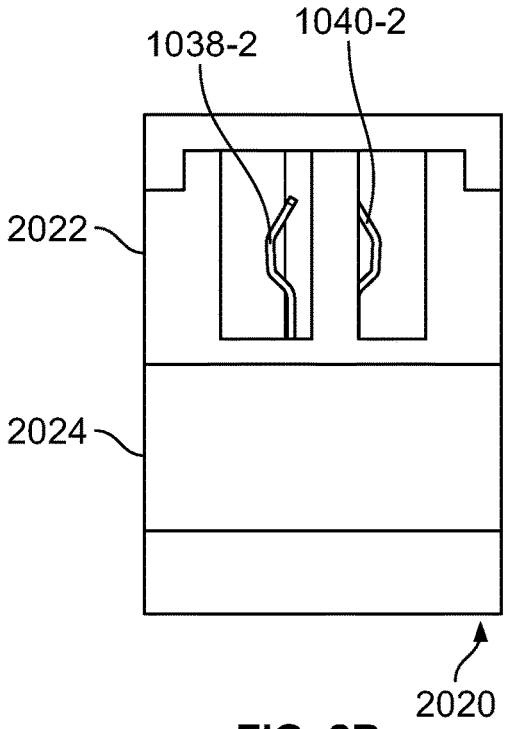
FIG. 2B is a front view illustrating a bar mount according to an exemplary embodiment of the present invention.
Figure 2C:
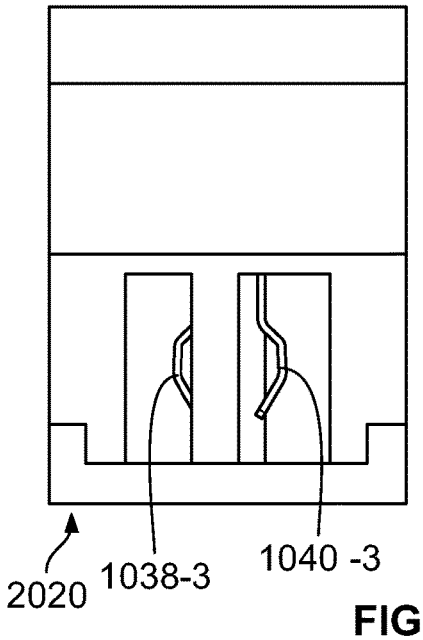
FIG. 2C is a side view illustrating the bar mount of FIG. 2B.
Figure 2D:
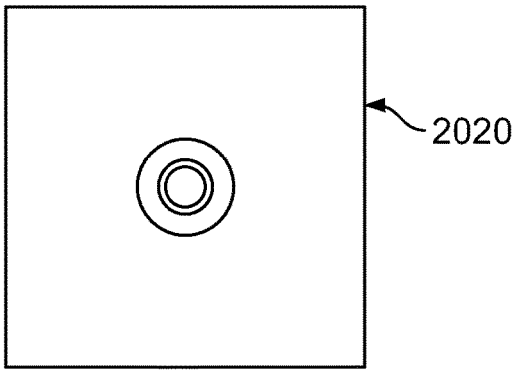
FIG. 2D is a top view illustrating the bar mount of FIG. 2B.
Figure 2E:
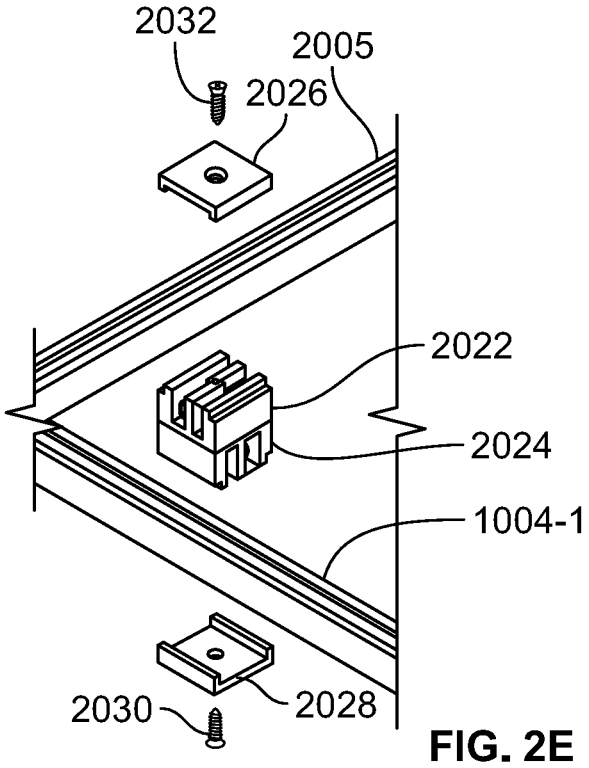
FIG. 2E is an exploded perspective view illustrating the bar mount of FIG. 2B.
Figure 2F:
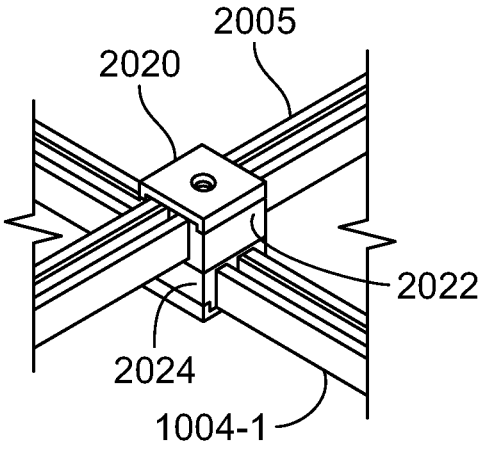
FIG. 2F is a perspective view illustrating the bar mount of FIG. 2B.

Referring to FIGS. 2E-2F, screws 2030 and 2032 may be used (e.g., screwed into the bar mount 2020) with caps 2026 and 2028 in order to secure the power bars 2005 and 1004-1 to the bar mount 2020.

Referring to FIGS. 2B-2C, the bar mount 2020 may include a first pair of electrical contacts 1038-2 and 1040-1, and a second pair of electrical contacts 1038-3 and 1040-3. The electrical contacts 1038-2 and 1040-2 are configured to make electrical contact with the power bar 2005, and the electrical contacts 1038-3 and 1040-3 are configured to make electrical contact with the power bar 1004-1. In addition, the electrical contacts 1038-2 and 1038-3 may be electrically connected to one another, for example, by internal wiring in the bar mount 2020. The electrical contacts 1040-2 and 1040-3 may be electrically connected to one another as well. Thus, the power bars 2005 and 1004-1 may be electrically connected to one another through the bar mount 2020.

The power bar 2005 may be electrically and structurally connected to the power bar 1004-2 in a similar manner as that described above for the power bars 2005 and 1004-1.

Although not shown in FIG. 2A, the power bars 1004-1 and 1004-2 may also extend at an angle other than 90 degrees with respect to the power bars 1004-1 and 1004-2. In this case a rotational bar mount 2042 (see FIG. 1D) may be used to connect the power bar 2005 with the power bars 1004-1 and 1004-2. The rotational bar mount 2042 may have a first portion 2022-1 and a second portion 2022-2 which are configured to electrically and structurally couple the power bar 2005 with the power bars 1004-1 and 1004-2. However, the first portion 2022-1 may be rotatably coupled to the second portion 2022-2 of the bar mount 2042 as shown in FIG. 1D by the curved arrows. Thus, the rotational bar mount 2042 may be used to connect power bars at various angles with respect to one another. Each bar mount 2042 may be flush with the two power bars that it is coupled to.

Figure 2G:
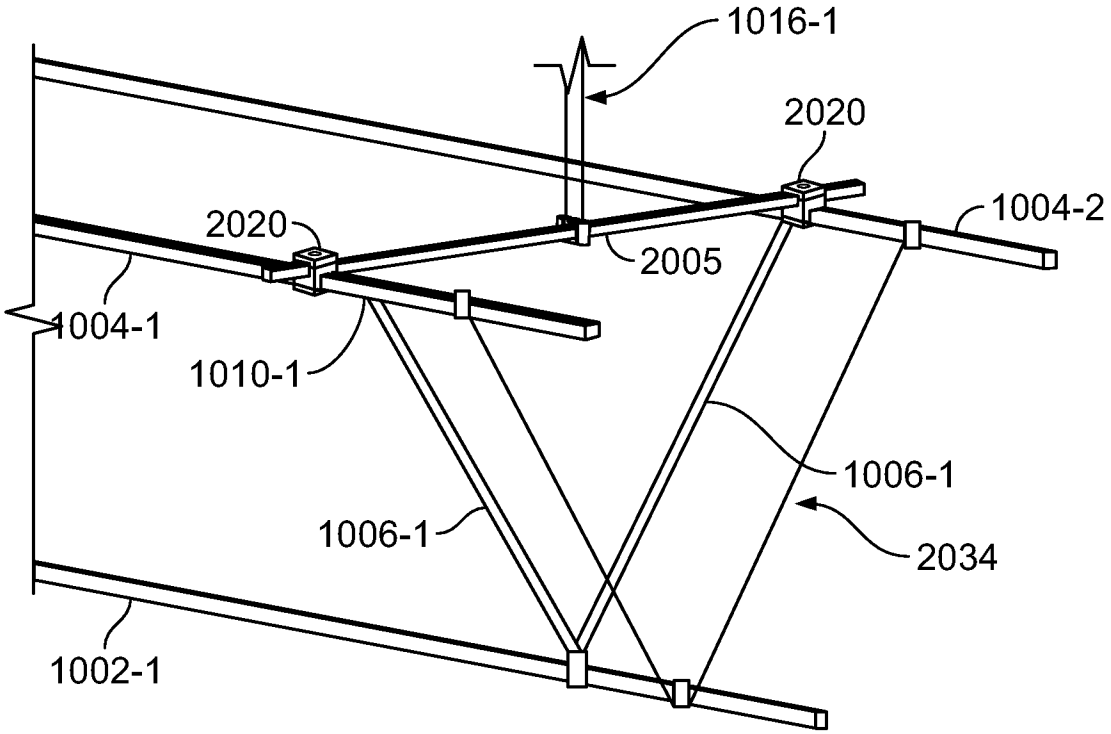
FIG. 2G is a perspective view illustrating a portion of a lighting system according to an exemplary embodiment of the present invention.
Figure 2H:
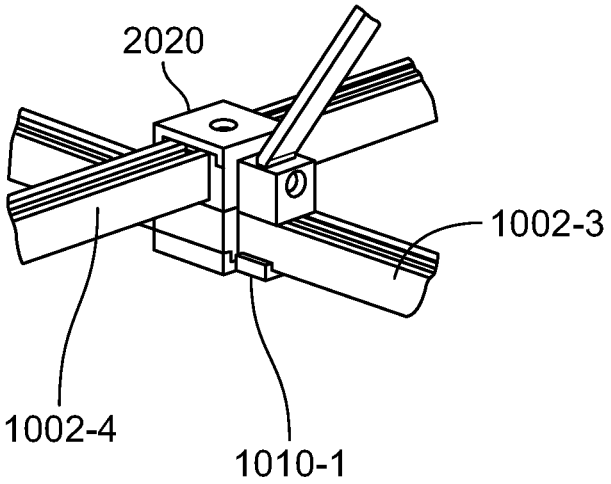
FIG. 2H is a magnified view illustrating a joint of the lighting system of FIG. 3A, according to an exemplary embodiment of the present invention.

Referring to FIGS. 2G-2H, each of the bars 1006-1 may be connected to either the power bar 1004-1 or 1004-2 through a bar connector 1010-1 (similar to the bar connector 1010), and a pair of bars 1006-1 may be connected to one another and to the power bar 1002-1 thorough a bar connector 1008-1 (similar to the bar connector 1008). Since the bar connectors 1008-1 and 1010-1 are electrical insulators, electrical power is not transferred to the power bar 1002-1 thorough the bars 1006-1.

A joint at the connection between two power bars (e.g., the power bar 2005 and the power bar 1004-1 or 1004-2) and a bar (e.g., a bar 1006-1) may be formed as shown in FIG. 2H, by using a bar mount 2020 to connect the two power bars to one another and by using a bar connector 1010-1 to connect the bar to one of the two power bars.

In the embodiment of FIGS. 2A and 2G, the power supply member 1016-1 may be structurally and electrically connected to the power bar 2005. However, the present invention is not limited thereto, and the power supply member 1016-1 may also be electrically and structurally connected to the power bar 1004-1 and/or the power bar 1004-2. The power supply member 1016-1 may be similar to the power supply member 1016, but may omit the first power connector 1048.

Since the power supply member 1016-1 may be connected to the power bar 2005, the power bars 1004-1 and 1004-2 may be electrically connected to the power supply member 1016-1 through the bar mounts 2020.

In the embodiment of FIGS. 2A and 2G, electrical power may be transferred to the power bar 1002-1 from the power bar 1004-1 and/or the power bar 1004-2 through a power transfer member 2034.

Figure 2I:
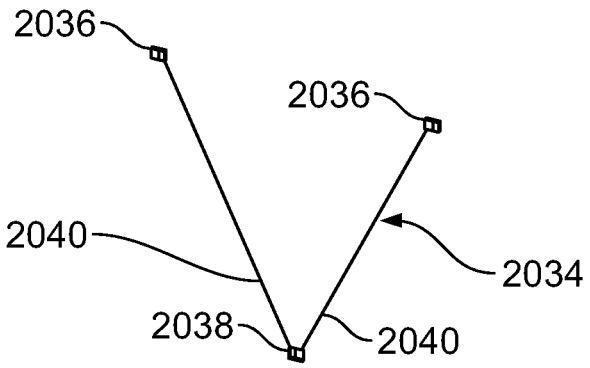
FIG. 2I is a perspective view illustrating a power transfer member according to an exemplary embodiment of the present invention.

Referring to FIG. 2I, the power transfer member 2034 may include a pair of power connectors 2036, a power connector 2038, and a pair of electrical cables 2040 which form a V-shape similar to that formed by the bars 1006-1.

Each of the power connectors 2036 may be electrically connected to the power bars 1004-1 and 1004-2 in a similar manner as the power connector 1050. Thus, each of the power connectors 2036 and 2038 may have structural configuration that is similar to the configuration of the second power connector 1050 described above.

Each of the power connectors 2036 may be electrically connected to both of both electrical conductors of the power bars 1004-1 and 1004-2. Alternatively, one of the power connectors 2036 may be electrically connected to only one of the terminals (e.g., the positive terminal) of one of the power bars 1004-1 and 1004-2 with the other of the power connectors 2036 being connected to the other power terminal (e.g., the negative terminal) of the of the other power bar.

The pair of electrical cables 2040 may electrically connect the pair of power connectors 2036 with the power connector 2038. The power connector 2038 may also have a configuration similar to that of the second power connector 1050 described above. Thus, the power connector 2038 may electrically connect the pair of electrical cables 2040 with the power bar 1002-1. In other words, the power transfer member 2034 may be used for electrically connecting the power bar 2001 with the power bars 1004-1 and 1004-2. Accordingly, all of the luminaires that may be electrically connected to the power bar 1002-1 may be fed with electrical power.

The lighting system 2000 may include a plurality of triangular structures formed by the connecting a power bar 2005 with a pair of bars 1006-1, as shown in FIG. 2A. Each of the power bars 2005 may be supported by two hangers 1014-1, as shown in FIG. 2A. However, one of the power bars 2005 of the lighting system 2000 may be supported by the power supply member 1016-1, as shown in FIG. 2A.

As shown in FIG. 2A, the lighting system 2000 may include different luminaires 2100 and 2200. Each of the luminaires 2100 and 2200 may be may be downwardly-oriented light structures. In addition, each of the power bars 1002-1, 1004-1 and 1004-2 may be used for structurally supporting luminaires and for proving electrical power to the luminaires. Thus, as shown in FIG. 2A, the lighting system 2000 may include three rows of luminaires in two different heights. For example, the luminaires 2200 may be disposed at the top elevation of the lighting system 2000 (e.g., the luminaires 2200 may be selectively coupled to the power bars 1004-1 and 1004-2), and the luminaries 2100 may be disposed at the bottom elevation of the lighting system 2000 (e.g., the luminaires 2100 may be selectively coupled to the power bars 1002-1).

Although the lighting system 2000 is described as having power bars that span across the entire length of the truss structure, it is understood that the truss structure of the lighting system 2000 may also be formed of shorter power bars that are connected to one another similarly to the power bars 1002 and 1004 of the lighting system 1000.

Figures 2J, 2K:
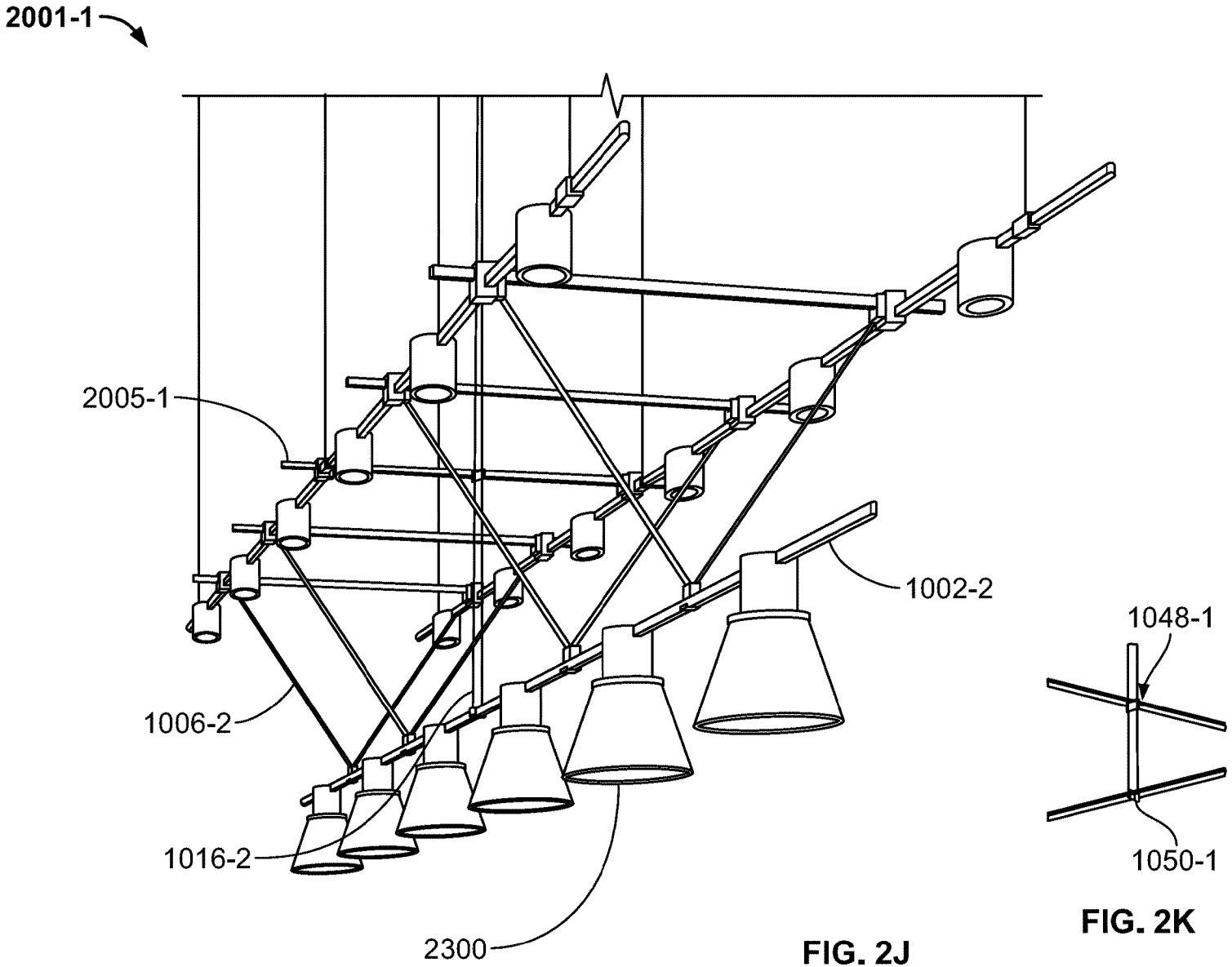
FIG. 2J illustrates a lighting system according to an exemplary embodiment of the present invention.
FIG. 2K is a perspective view illustrating a power transfer member according to an exemplary embodiment of the present invention.

FIG. 2J illustrates a lighting system 2000-1 according to an exemplary embodiment of the present invention. The lighting system 2000-1 may be similar to the lighting system 2000 with several exceptions. For example, the lighting system 2000-1 may have a power supply member 1016-2 that is different from the power supply member 1016-1.

Referring to FIG. 2J, the power supply member 1016-2 may be electrically connected to both the power bar 2005-1 at the top of the truss structure and to the power bar 1002-2 at the bottom of the truss structure. Referring to FIG. 2K, the power supply member 1016-2 may be configured to supply electrical current to a pair of power bars that are disposed at different elevations and which extend in different directions with one another. For example, as shown in FIG. 2K, the power supply member 1016-2 may be used to supply with electrical current two power bars that extend perpendicularly to one another. Referring to FIG. 2K, a first power connector 1048-1 and a second power connector 10501 of the power supply member 1016-2 may be aligned at substantially perpendicularly to one another. The first and second power supply connectors 1048-1 and 1050-1 may otherwise be similar in construction to the first and second power supply connectors 1048 and 1050 of the power supply member 1016.

Since the lighting system 2000-1 includes the power supply member 1016-2 for supplying electricity to the power bar 1016-2 at the bottom of the truss, the lighting system need not utilize the power transfer member 2034 in order to electrify the power bar 1016-2.

In addition, the lighting system 2000-1 may include glass cone luminaires 2300 and may have a different number of power bars 2005-1 and 1016-2 as their respective counterparts in the lighting system 2000.

Figure 2L:
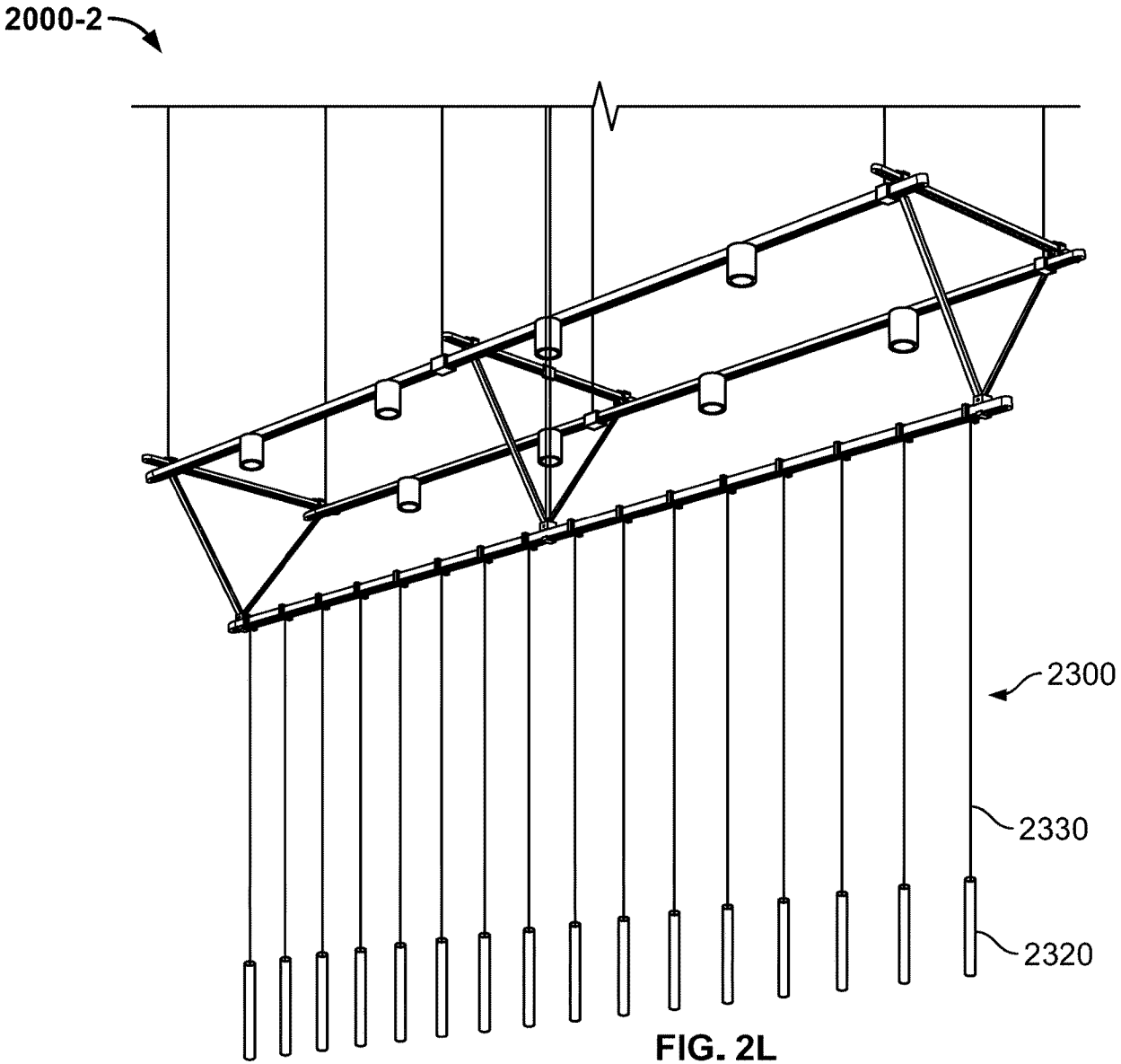
FIG. 2L illustrates a lighting system.

FIG. 2L illustrates a lighting system 2000-2. The lighting system 2000-2 may include pendant lights 2300 which have a light emitting portion 2320 hung at a desired elevation from the bottom power bar via a cable 2330. The length of the cables 2330 may be set as needed in order to hang the light emitting portions 2320 at a desired elevation. In addition, the pendant lights 2300 need not be hung at the same elevation. Thus, the pendant lights 2300 may have cables 2330 of different lengths.

Figure 3B:
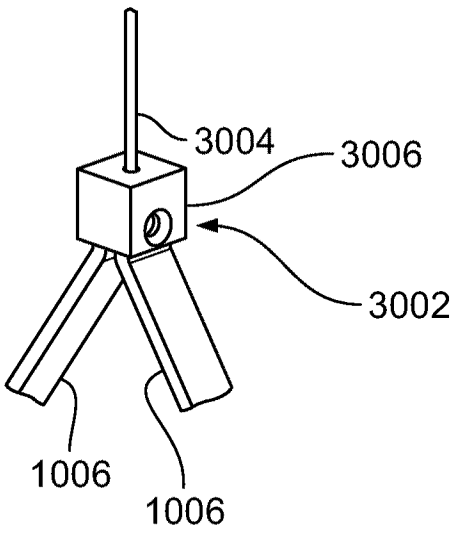
FIG. 3B is a magnified view of a joint of the lighting system of FIG. 3A.
Figure 3A:
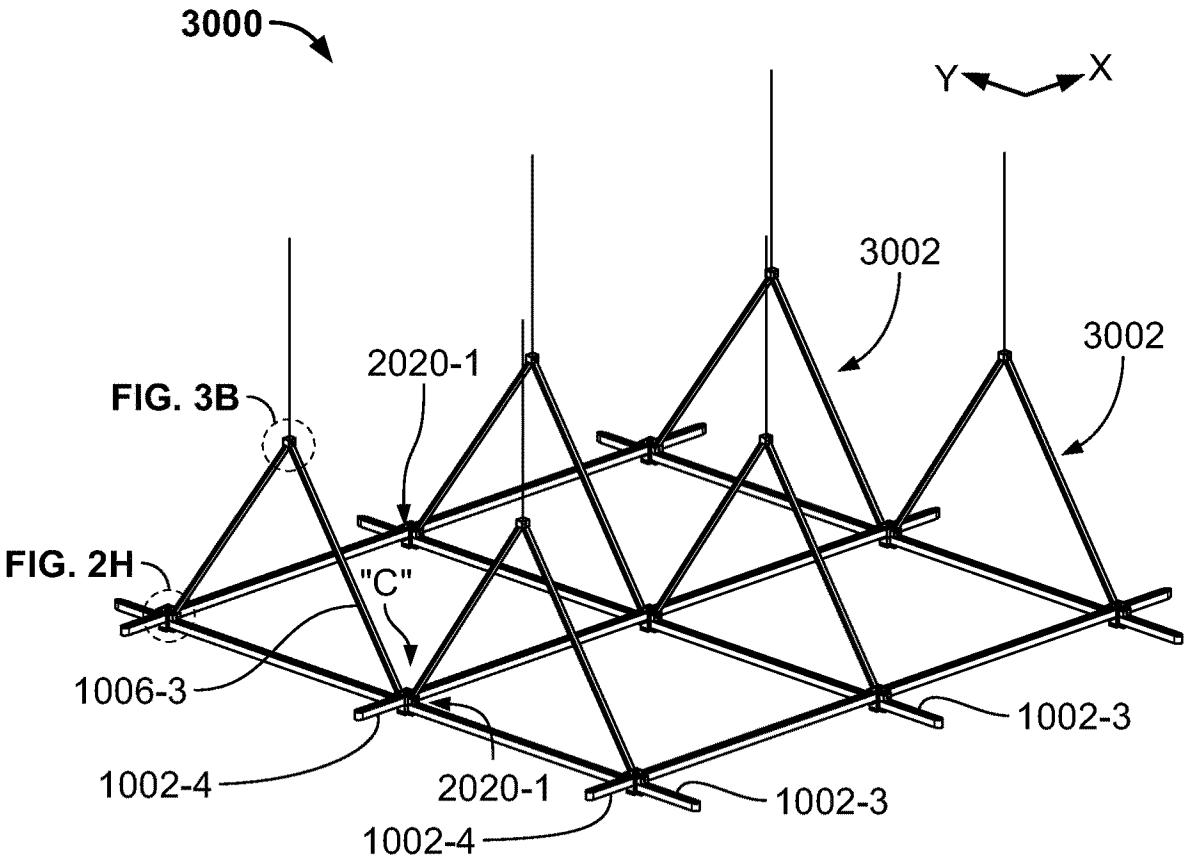
FIG. 3A is a perspective view illustrating a lighting system according to an exemplary embodiment of the present invention.

FIG. 3A illustrates a lighting system 3000 according to an exemplary embodiment of the present invention.

Referring to FIG. 3A, the lighting system 3000 may include a platform/platform assembly of power bars. The platform of power bars includes a plurality of power bars 1002-3 spaced apart from one another and extending along a first direction "Y". The platform of power bars may also include a plurality of power bars 1002-4 spaced apart from one another and extending along a second direction "X". The first and second directions "Y" and "X" may cross one another. In an embodiment, as shown in FIG. 3A, the first and second directions "Y" and "X" may extend perpendicularly to one another.

Referring to FIGS. 3A and 2H, at each crossing between a power bars 1002-3 and 1002-4 of FIG. 3A, the power bars 1002-3 and 1002-4 may be structurally and electrically connected to one another by a bar mount 2020-1, similarly to the connection shown in FIG. 2H for the bar mount 2020. By connecting each of the power bars 1002-3 and 1002-4 at all of their crossing points, the platform of power bars of FIG. 3 is created.

It is understood that the power bars 1002-3 and 1002-4 may, but need not be connected to one another at each location where they cross one another (through the bar mount 2020-1). However, each of the power bars 1002-3 should be connected to at least two power bars 1002-4 at two different locations via the bar mounts 2020-1 for structural support. Similarly, each of the power bars 1002-4 should be connected to at least two power bars 1002-3 at two different locations via the bar mounts 2020-1 for structural support.

As shown in FIG. 3A, the power bars 1002-4 are disposed over the power bars 1002-3, but this is merely exemplary. Alternatively, the power bars 1002-3 may be disposed over the power bars 1002-4.

The platform of FIG. 3A may be hung from a ceiling via a plurality of hanging structures 3002. The hanging structures 3002 will be described with reference to FIGS. 3B-3I.

Referring to FIGS. 3B to 3I, a hanging structure 3002 may include a suspension cable 3004 having an end configured to be attached to the ceiling and an opposite end having a ferrule 3008 attached thereto, a bar connector 3006, a pair of bars 1006-3, and a pair of bar connectors 1010-4, and a plurality of screws (not shown).

The ferrule 3008 may have a larger diameter "d1" (see FIGS. 3C and 3H) than a diameter "d2" of a through hole 3010 in the bar connector 3006. Since the ferrule 3008 cannot pass through the hole 3010, the bar connector 3006 may be hung on the suspension cable 3004.

Referring to FIG. 3H, a screw 3010 may be configured to be inserted in an opening 3014 of the bar connector 3006 and through the holes 3012 of the end portions of each of the two bars 1006-3 when the end portions of each of the two bars 1006-3 are inserted in an "H" shaped opening (see FIG. 3C) of the bar connector 1006. Alternatively, a nut and bolt mechanism may be used to fasten the pair of bars 1006-3 to the bar connector 3006.

Referring to FIG. 3A, the opposite ends of the hanging structure 3002 may be connected to the power bars 1002-3 (as shown in FIG. 2H). The connection between the ends of the bars 1006-3 of FIG. 3A and the power bars 1002-3 of FIG. 3A may be identical to the connection described in detail above with reference to FIGS. 1AJ-1AP via the bar connectors 1010-1.

As shown in FIG. 3A, each of the hanging structures 3002 may be centered between a pair of adjacent power bars 1002-4. In addition, as shown in FIGS. 3A and 2H, each of the bar connectors of the hanging structures 3002 (which are similar or exactly the same as the bar connectors 1010-1 of FIGS. 1AJ-1AP) may be disposed adjacent to the bar mounts 2020-1 as shown in FIG. 2H. Although FIG. 2H illustrates only one bar connector 1010-1 disposed adjacent to the bar mount 2020, the bar mount 2020-1 at location "C" of FIG. 3A has two bar connectors 1010-1 disposed at opposite sides of the bar mount 2020-1. As shown in FIG. 3A, at location "C" the two bar connectors 1010-1 and two bars 1006-3 of the two adjacent hanging structures 3002 may be mirror opposites to one another about the center of the bar mount 2020-1.

FIG. 3A illustrates that the hanging structures 3002 are connected to the power bars 1002-3 in order to support the weight of the lighting system 3000. Alternatively, or in addition, the hanging structures 3002 may be connected to the power bars 1002-4 in order to support the weight of the lighting system 3000.

Since one hanging structure 3002 support two joints (or two power bar crossings) of the lighting system 3000 via a single cable hung from the ceiling, the lighting system 3000 needs a smaller number of cables for structural support (e.g., for being hung from the ceiling) than otherwise would be needed if one cable was used to support each joint of the lighting structure. Thus, the lighting system 3000 can be quickly and efficiently installed.

The lighting system 3000 of FIGS. 3A-3I is illustrated without luminaires or pendant lights for clarity of purposes. It is understood that a plurality (and combination) of the luminaires and pendant lights described above (as well as the "V"-line luminaires to be described below) may be electrically coupled to the lighting system 3000. The luminaires and pendant lights may be electrically coupled to the power bars 1002-3 and/or 1002-4.

A power supply member 1016-3 (see FIG. 3J) may be connected to either one of the power bars 1002-3 or to the power bars 1002-4 for supplying electrical power to the entire lighting system 3000. The power supply member 1016-3 may be similar to the power supply member 1016-1 of FIG. 2A.

Figure 3J:
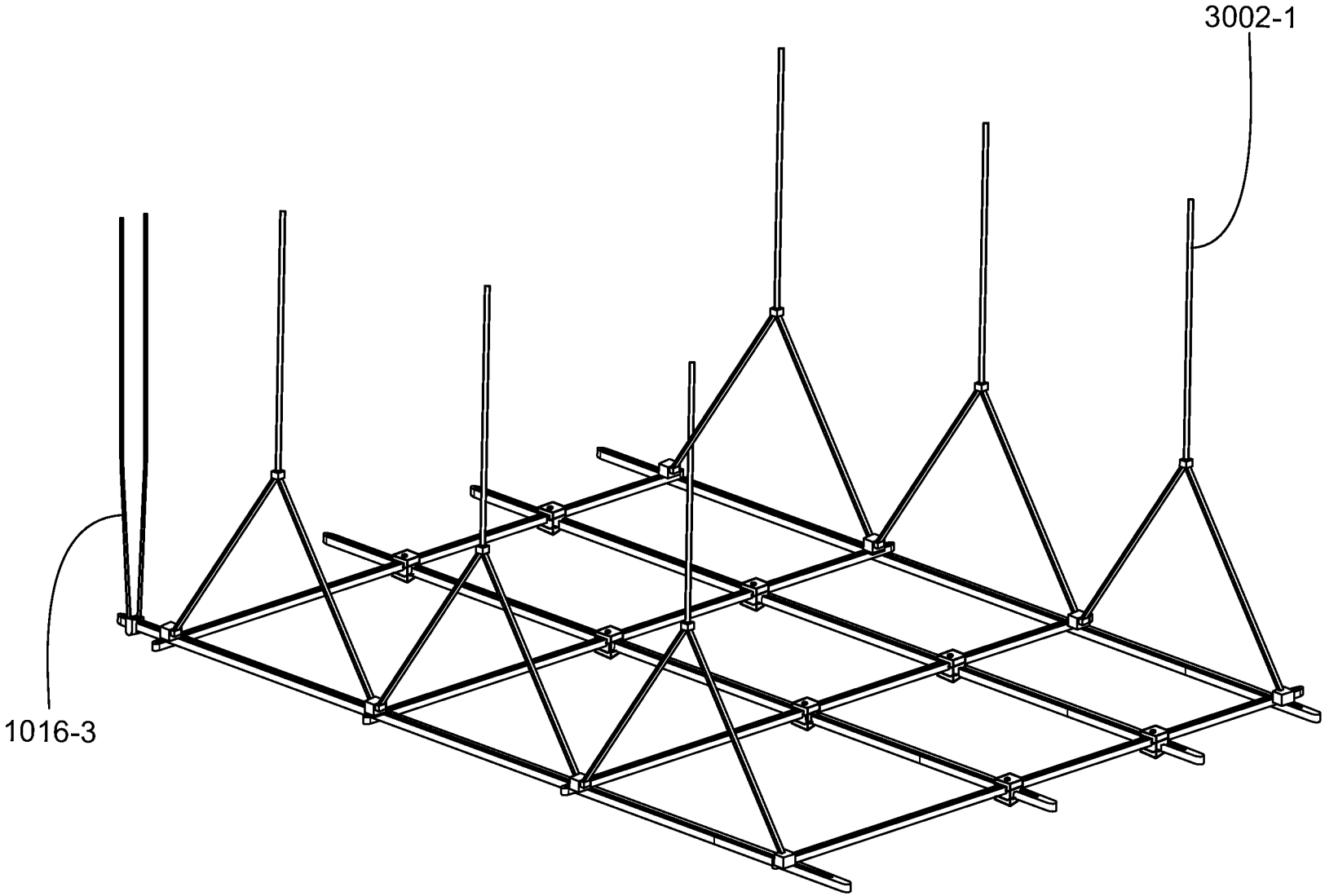
FIG. 3J illustrates a lighting system.
Figure 3K:
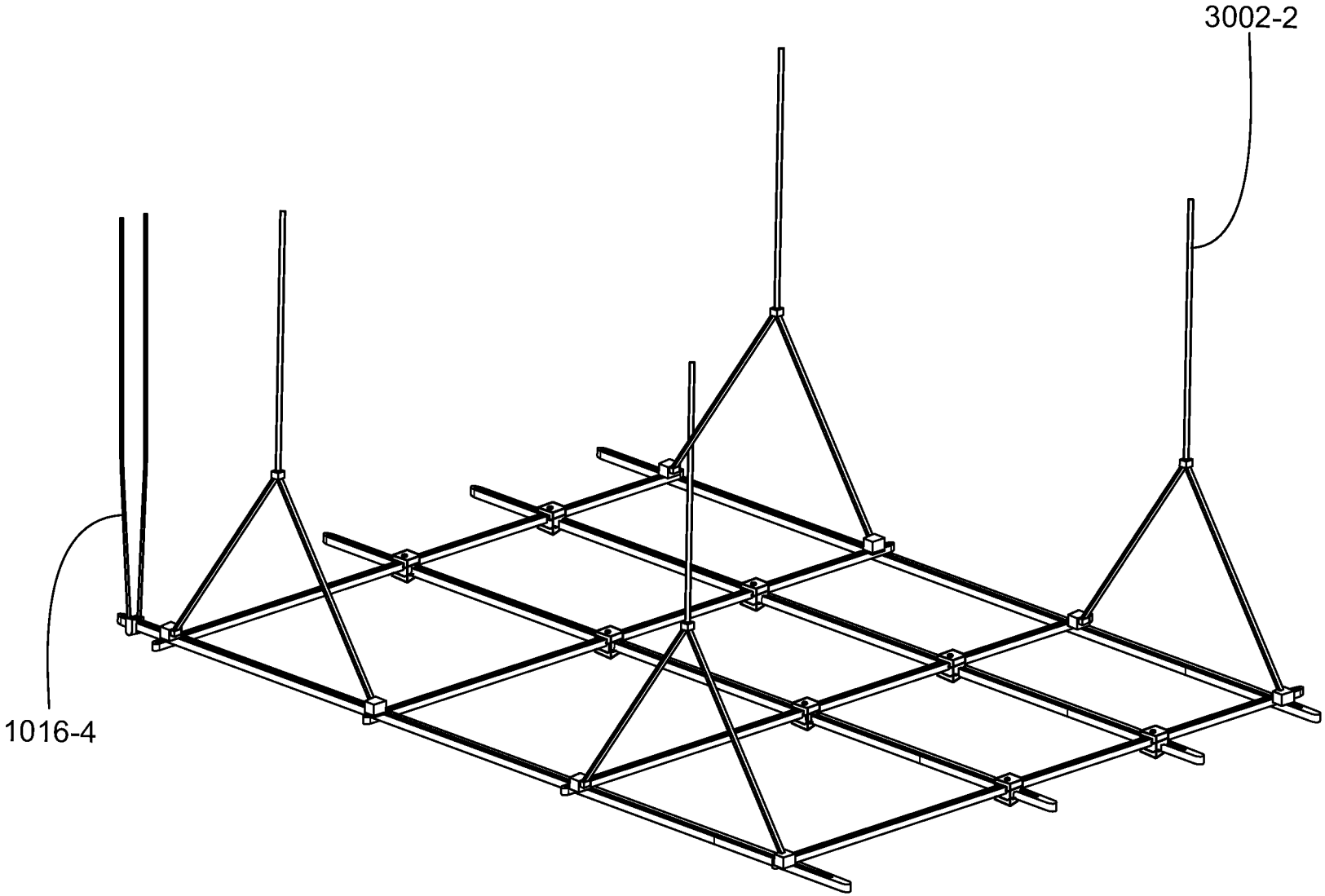
FIG. 3K illustrates a lighting system.
Figure 3L:
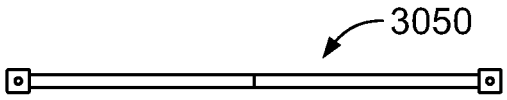
FIG. 3L illustrates a bottom view of a hanging structure.
Figure 3M:
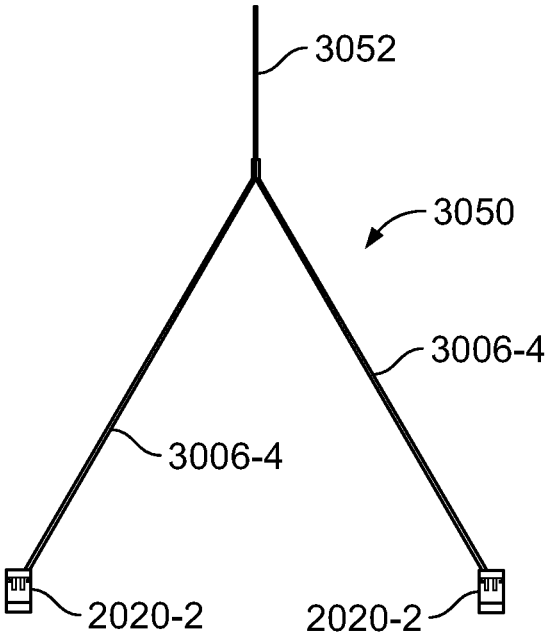
FIG. 3M illustrates a front view of the hanging structure of FIG. 3L.
Figure 3O:
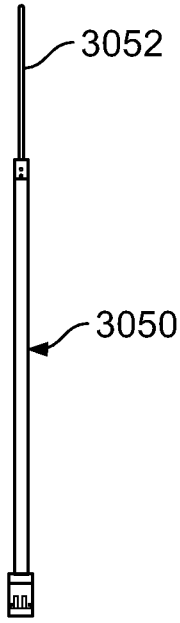
FIG. 3O illustrates a side view of the hanging structure of FIG. 3L.
Figure 3N:
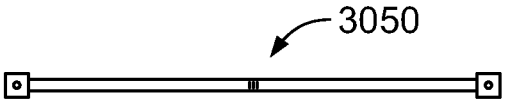
FIG. 3N illustrates a top view of the hanging structure of FIG. 3L.

Referring to FIGS. 3J and 3K, a lighting system may include a 4×4 platform. The 4×4 platform may be a platform having four power bars extending in a first direction and being spaced from one another, and a four power bars extending in a second direction crossing the first direction and being spaced from one another. In FIG. 3J, the 4×4 platform is supported by using six hanging structures 3002-1, which may be identical to the hanging structures 3002. In FIG. 3K, the 4×4 platform is supported by using four hanging structures 3002-2, which may be identical to the hanging structures 3002.

Thus, the number of hanging structures that may be used to hang a lighting system platform from the ceiling may be varied as needed according to the size, configuration and weight of the lighting system. The weight of the lighting system may include the weight of the platform, and the weight of the luminaires and/or pendant lights that will be attached to the platform. Since the platform of power bars can extend over a large area in order to provide illumination thereto, and since the power bars are relatively small in size and lightweight, the lighting system can be lightweight while providing illumination to a large floor area.

FIGS. 3L-3Q illustrate a hanging structure 3050 according to an exemplary embodiment. The hanging structure 3050 may be used interchangeably with, in addition to, or instead of the hanging structures 3002, 3002-1, and 3002-2 to hang a platform structure from the ceiling. The cables of hanging structures 3002, 3002-1, and 3002-2 (which are fastened to the ceiling) may be electrically isolated from the platform.

Referring to FIGS. 3L-3Q, the hanging structure 3050 may include a hanging cable 3052 that mounts to the ceiling, a pair of bars 3006-3 that are connected to the cable 3052, and a pair of bar mounts 2020-2 connected to the ends of the bars-3006-4.

Figure 3Q:
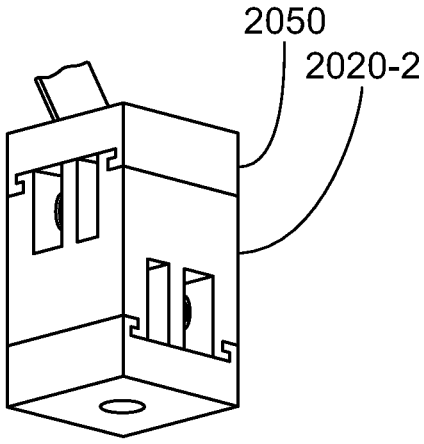
FIG. 3Q is a magnified view illustrating a portion of the structure of FIG. 3P.
Figure 3P:
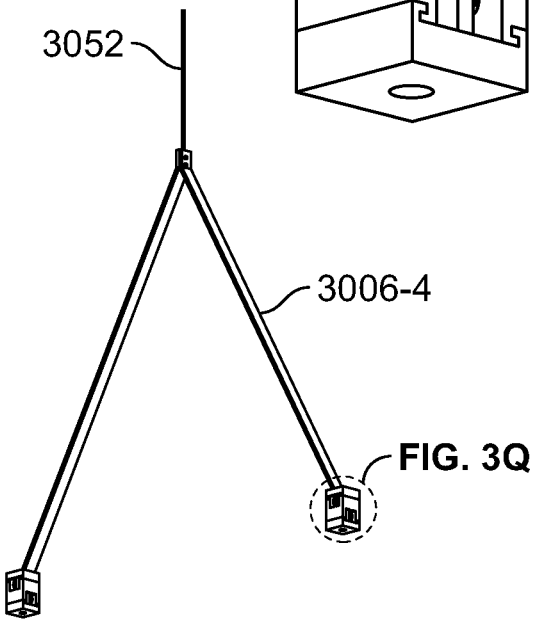
FIG. 3P illustrates a perspective view of the hanging structure of FIG. 3L.

Referring to FIGS. 3P-3Q, each bar 3006-4 may be connected to its respective bar mount 2020-2, through, for example, a cap 2050 (see FIG. 3Q) of the bar mount 2020-2. The cap 2050 of the bar mount may be selectively connected to the body of the bar mount 2020-2 via, for example, a screw, as shown in FIGS. 2B-2F. Thus, the hanging structure 3050 may be used to electrically and structurally connect three power bars (e.g., two parallel power bars and one additional bar which crosses the two parallel power bars) at the two locations where the three power bars cross one another.

Figure 3S:
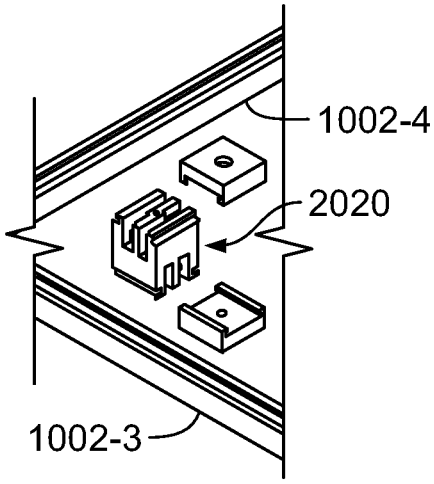
FIG. 3S is an exploded perspective view illustrating the bar mount and the pair of power bars of FIG. 3R.
Figure 3R:
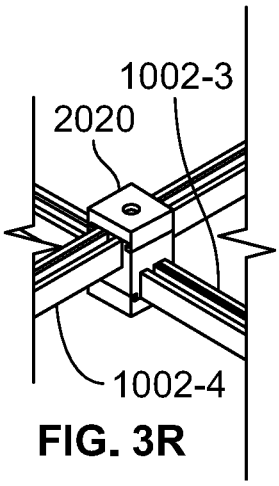
FIG. 3R is a perspective view illustrating a bar mount connected to a pair of power bars.

FIG. 3R is a perspective view illustrating a bar mount 2020 connected to a pair of power bars 1002-3 and 1002-4. FIG. 3S is an exploded perspective view illustrating the bar mount 2020 and the pair of power bars 1002-3 and 1002-4 of FIG. 3R.

Figure 4:
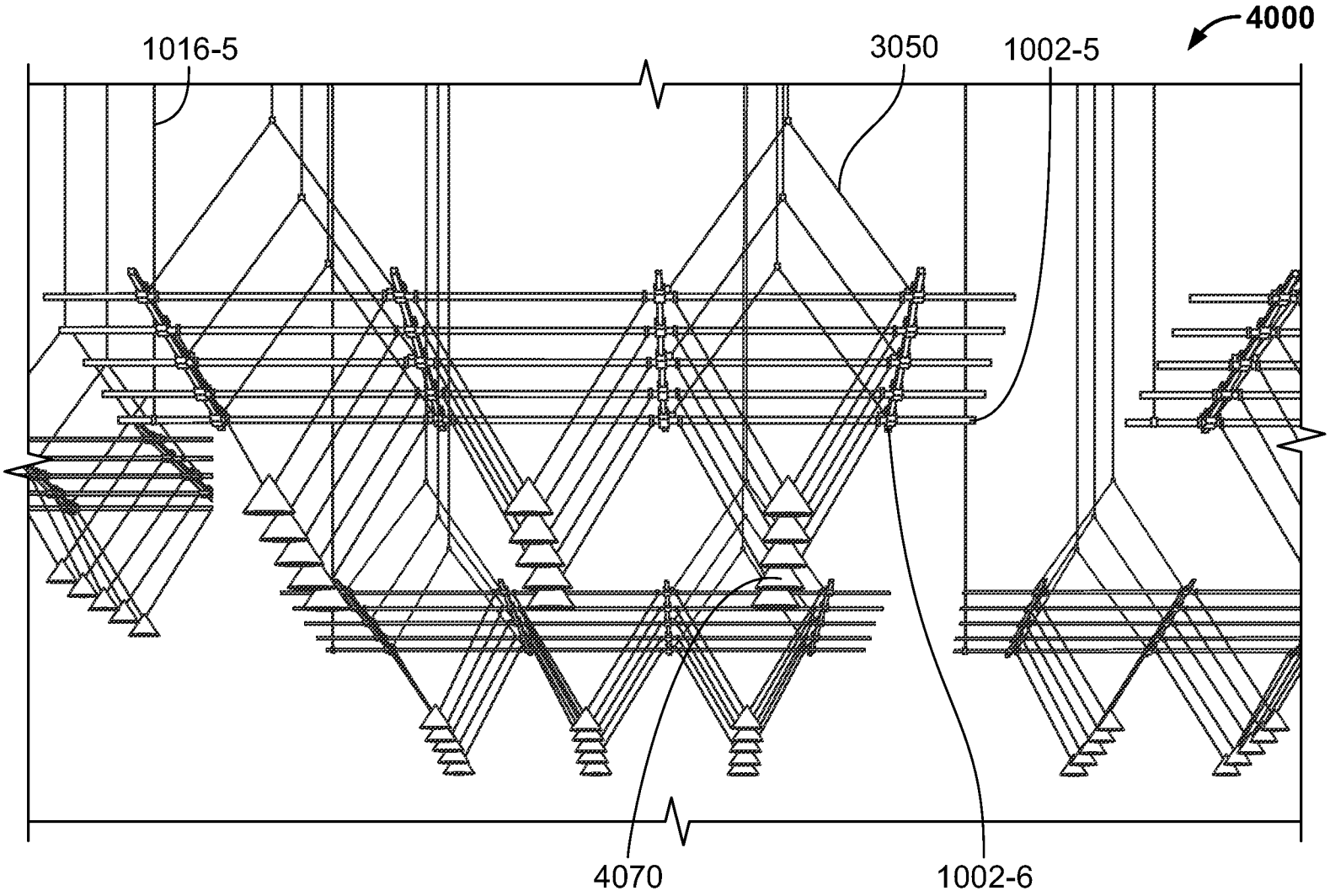
FIG. 4 is a perspective view illustrating a lighting system according to an exemplary embodiment of the present invention.

FIG. 4 is a perspective view illustrating several lighting systems 4000, according to an exemplary embodiment of the present invention. One of the lighting systems 4000 will be described in detail below.

Referring to FIG. 4, the lighting system 4000 may include a plurality of hangers 3050, a 4×5 platform, a plurality of "V" type cone luminaires 4070, and a power supply member 1016-5. The power supply member 1016-5 may be similar to the power supply member 1016-1 of FIG. 2A.

As shown in FIG. 4, the 4×5 platform may include five power bars 1002-5 extending in a first direction, and four power bars 1002-6 extending in a second direction crossing the first direction. As shown in FIG. 4, at each crossing between the power bars, the power bars may be electrically and structurally connected to one another by using a bar mount as described above.

As shown in FIG. 4, the 4×5 platform may by suspended by two rows of hangers 3050, and each row may include three hangers 3050.

Referring to FIG. 4, three rows of luminaires 4070 may be suspended from the 4×5. Each row may include five luminaires 4070.

Figure 5:
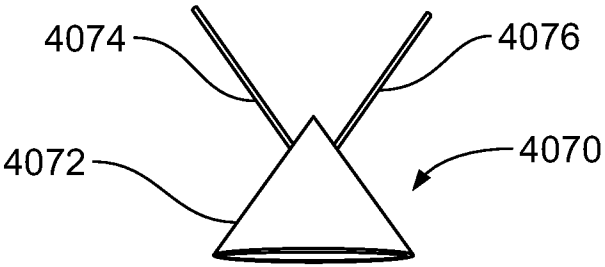
FIG. 5 is a perspective view of a luminaire of the present invention.

Referring to FIG. 5, a luminaire 4070 may include a cone-shaped light emitting structure 4072, a first cable 4074, and a second cable 4075. The first and second cables 4074 and 4076 may be used for supporting the weight of the luminaire 4070, in other words, for hanging the luminaire 4070 from the power bars 1002-5. In addition, the first and second cables 4074 and 4076 may be used to supply the light emitting structure 4072 with electrical power for emitting light.

As shown in FIG. 4 the first and second cables 4074 and 4076 of each luminaire 4070 may be electrically and structurally connected to the power bars 1002-5 adjacent to the locations where the power bars 1002-5 cross the power bars 1002-6. In other words, the first and second cables 4074 and 4076 of each luminaire may be electrically and structurally connected to the power bars 1002-5 adjacent to the bar mounts.

The ends of the first and second cables 4074 and 4076 that are connected to the power bar may have a selectable connection mechanism attached thereto, similar to the bar mount 2020 (but smaller than the bar mount 2020) for selectively electrically and structurally connecting the luminaire 4070 to a power bar.

The "V" shape of the luminaire 4070 complements the shape of the hangers 3050 to create a light weight and strong lighting system.

Figure 6:
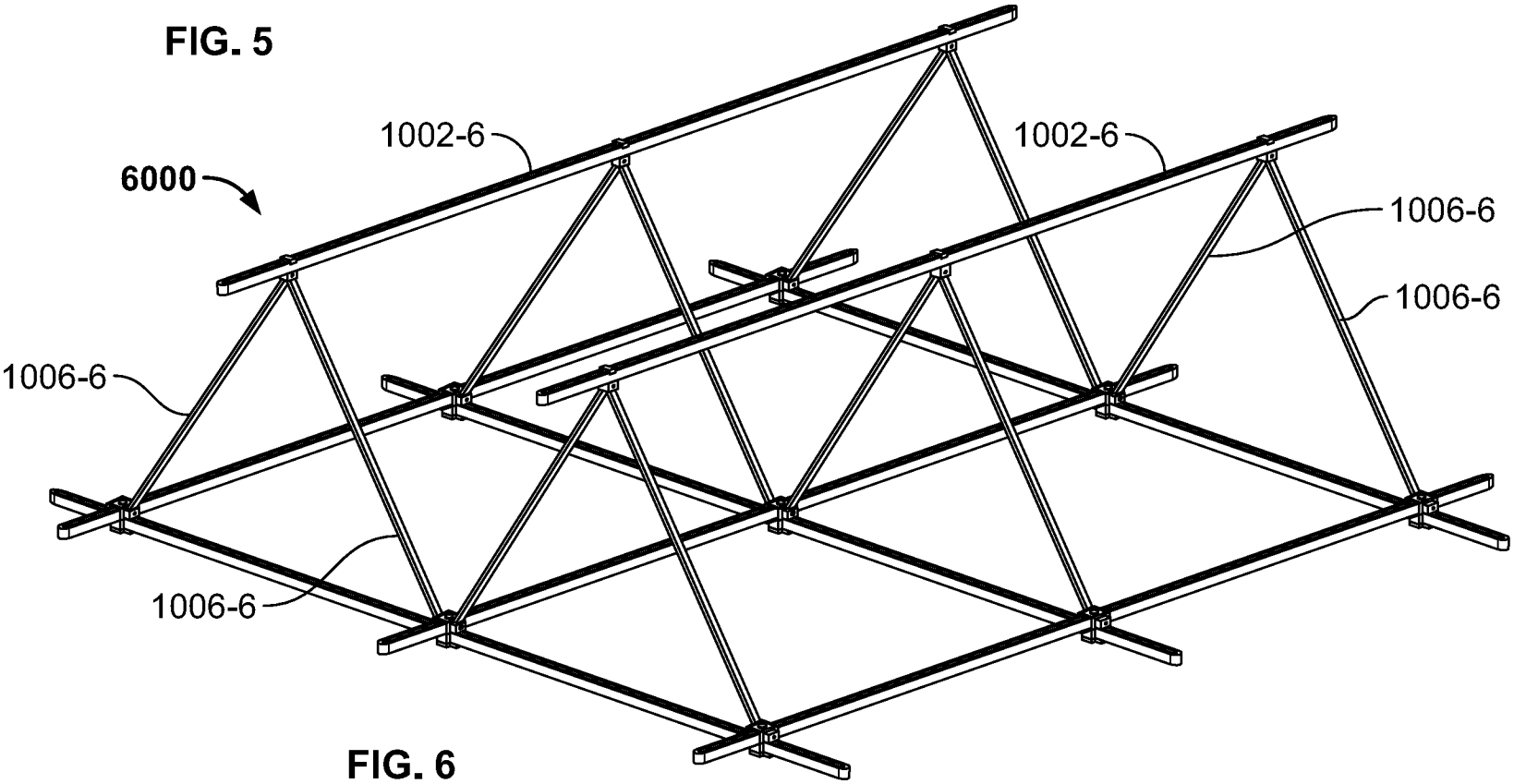
FIG. 6 is a perspective view illustrating a lighting system according to an exemplary embodiment of the present invention.

FIG. 6 illustrates a lighting system 6000 according to an exemplary embodiment of the present invention.

Referring to FIG. 6, the lighting system 6000 may have a 3×3 platform. The 3×3 platform may include six power bars connected to one another via bar hangers as described above.

The lighting system 6000 may include a plurality of bars 1006-6 connected to a top power bar 1002-6 similar to the bars 1006-1 and the power bar 1002-1 of FIG. 2A. However, unlike the power bar 1002-1 of FIG. 2A (which is located at the bottom of the truss), the power bar 1002-6 is located at the top of the truss formed by the lighting system of 6000.

Although not shown in FIG. 6, a plurality of hangers may be connected to the 3×3 platforms, and/or to the power bars 1002-6. The number and configuration of the hangers used for connecting the truss of FIG. 6 to the ceiling may vary based on different factors (e.g., the weight of the platform, the weight of the luminaires, etc.) as described above.

In addition, either a power supply member 1016 (see FIG. 1A) or a power supply member 1016-2 (see FIG. 2J) may be used to provide electrical power to the 3×3 platform and to the bars 1006-2 such that the lighting system 6000 can be used to provide illumination on two different elevations. It is understood that the lighting system 6000 may be coupled to any of the luminaires and pendant lights described above.

Since the power bars 1002-6 of the lighting system of FIG. 1A are electrically insulated from the 3×3 platform, each bar 1006-2 needs to be separately provided with power from a power supply member if that power bar will be used to power luminaires and/or pendant lights.

Figure 7:
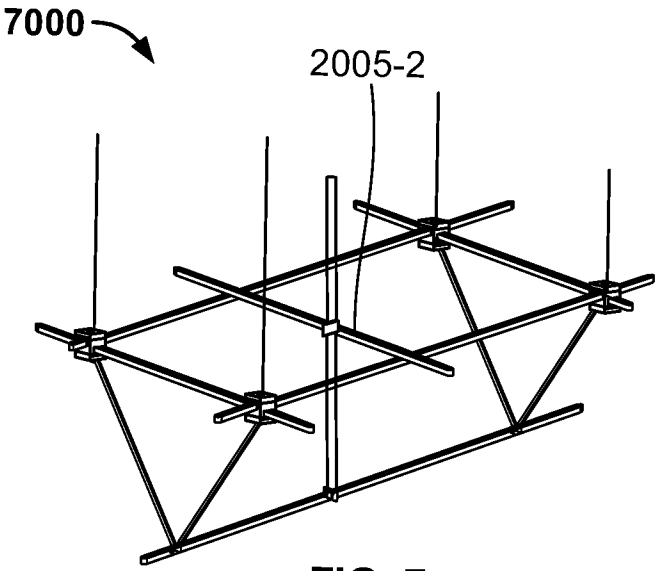
FIG. 7 is a perspective view illustrating a lighting system according to an exemplary embodiment of the present invention.

FIG. 7 illustrates a lighting system 7000. The lighting system 7000 may be similar to the lighting system 200-1 of FIG. 2J, but the location of the power bars 2005-2 at the middle of the lighting system (see FIG. 7) is not supplied with the bars that would extend in a "V" shape from the power bar at the bottom to the two power bars at the top of the truss. In other words, a truss structure need not be provided with bars at every location where the power bars cross with one another.

Figure 9:
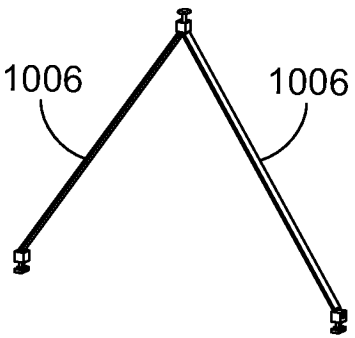
FIG. 9 is a perspective view illustrating a component of bars and bar connectors that may be included in the structure of the lighting system of FIG. 1A.
Figure 8:
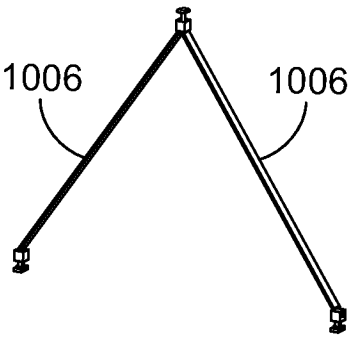
FIG. 8 is a perspective view illustrating a component of bars and bar connectors that may be included in the structure of the lighting system of FIG. 7.

FIG. 8 illustrates a pair of bars 1006 that may be included in the structure of the lighting system of FIG. 7. FIG. 9 illustrates a pair of bars 1006 that may be included in the structure of the lighting system of FIG. 1A.

Figure 11:
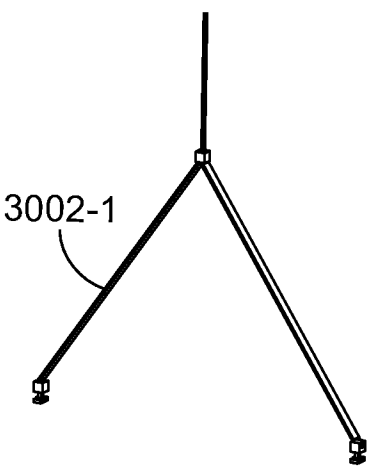
FIG. 11 is a perspective view illustrating hanging structure that may be used to hang the lighting system of FIG. 3J.
Figure 10:
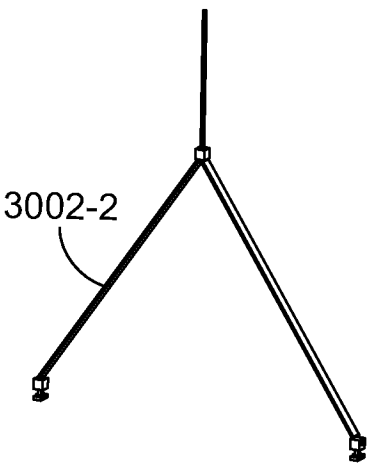
FIG. 10 is a perspective view illustrating hanging structure that may be used to hang the lighting system of FIG. 3K.

FIG. 11 is a magnified view illustrating a hanging structure 3002-2. FIG. 11 is a magnified view illustrating a hanging structure 3002-1.

As can be gathered, a lighting system of the present invention can be formed to provide illumination in large and irregularly-shaped areas. A lighting system of the present invention can be configured to have different sizes and shapes according to the lighting needs of a particular area, room, outdoor arena, etc. The lighting systems described above can be modified as needed and/or can be combined with one another according to the teachings of this specification in order to provide an unparalleled flexibility in lighting. For example, a lighting system which includes a planar truss can be combined and/or electrically/structurally connected to a lighting system which includes a space frame truss structure. Additionally, or lighting system having a truss with two elevation (as shown in FIG. 2*a*) may be modified to have three or more elevations for forming a multi-story truss structure according to the teachings of this specification.

Thus, the teachings of the present invention provide for a virtually endless number of ways in which a lighting system can be configured.

While the present invention has been particularly shown and described with reference to exemplary embodiments thereof, it will be apparent to those of ordinary skill in the art that various changes in form and detail may be made therein without departing from the spirit and scope of the present invention.

What is claimed is:

1. A lighting system comprising:

a truss structure for supporting one or more luminaires, the truss structure including:

first and second elongated and electrically conductive power bars spaced apart from one another;

a first set of bars connecting the first and second power bars to one another structurally but not electrically; and a power supply member connected to the truss structure for transmitting electrical power thereto from an external power source and for hanging the truss structure from a supporting structure, wherein each one of the first and second power bars is configured to selectively receive the one or more luminaires for structurally supporting the one or more luminaires and for transmitting electrical power thereto such that the one or more luminaires can emit light.

2. The lighting system of claim 1, wherein the first power bar has a pair of electrically conductive rails extending in parallel with one another along a length of the first power bar for transmitting electrical power to at least one of the one or more luminaires when the at least one of the one or more luminaires is selectively connected to the first power bar.

3. The lighting system of claim 1, wherein the first set of bars is arranged in a zig-zag formation between the power bars.

4. The lighting system of claim 1, further comprising a bar connector selectively connecting two bars of the first set of bars to the first power bar.

5. The lighting system of claim 1, wherein the power supply member includes:

a pair of wires extending between the first and second power bars;

a first power connector selectively connecting the pair of wires with the first power bar for transmitting electrical power to the first power bar; and a second power connector selectively connecting the pair of wires with the second power bar for structurally supporting the second power bar and electrically connecting the pair of wires with the second power bar.

6. The lighting system of claim 1, wherein the truss structure further comprises:

third and fourth elongated and electrically conductive power bars spaced apart from one another;

a first power bar connector selectively connecting the second and fourth power bars to one another structurally and electrically such that the fourth bar is electrically connected to the power supply member;

a hanger selectively connecting the first and third power bars to one another structurally and electrically such that the third bar is electrically connected to the power supply member and for hanging the truss structure from the supporting structure; and a second set of bars connecting the third and fourth power bars to one another structurally but not electrically.

7. A lighting system comprising:

a truss structure for supporting a plurality of luminaires at different heights, the truss structure including:

a first elongated power bar, a second elongated power bar and a third elongated power bar, wherein the first, second and third power bars are spaced apart from one another and each is electrically conductive;

a plurality of first bar elements spaced apart from one another with each first bar element structurally connecting the first and second power bars to one another, wherein at least one of the first bar elements electrically connects the first power bar to the second power bar;

a plurality of second bar elements spaced apart from one another with each second bar element structurally but not electrically connecting the third power bar to the first power bar; and a plurality of third bar elements spaced apart from one another with each third bar element structurally but not electrically connecting the third power bar to the second power bar;

wherein each one of the first, second and third power bars is configured to selectively receive at least one of the luminaires for structurally supporting the at least one luminaire and for transmitting electrical power thereto such that the at least one luminaire can emit light.

8. The lighting system of claim 7, further comprising a bar mount structurally and electrically connecting one of the first bar elements with the first power bar, wherein the bar mount includes:

a first opening configured to receive the one of the first bar elements therein;

a second opening configured to receive the first power bar therein; and electrical contacts disposed within the first and second openings for electrically connecting the one of the first bar elements with the first power bar.

9. The lighting system of claim 7, further comprising a power transfer member electrically connecting the third power bar with at least one of the first and second power bars such that a power supply member can be electrically connected to any one of the first, second and third power bars for supplying electrical power to each one of the first, second and third power bars.

10. The lighting system of claim 9, wherein the power transfer member includes:

a first power connector electrically connected to two conducting rails of the third power bar;

a second power connector electrically connected to two conducting rails of the first power bar; and a pair of electrical wires extending between the first and second power connectors and electrically connecting the first and second power connectors to one another.

11. The lighting system of claim 7, further comprising a bar connector connecting one of the second bar elements and one of the third bar elements to the third power bar.

12. The lighting system of claim 11, wherein the one of the second bar elements and the one of the third bar elements are respectively connected to the first and second power bars adjacent to one of the first bar elements such that the one of the first bar elements, the one of the second bar elements and the one of the third bar elements together from a triangular structure for supporting the first, second and third power bars.

13. A lighting system comprising:

a platform assembly including a plurality of first power bars spaced apart from one another and extending in a first direction, and a plurality of second power bars spaced apart from one another and extending in a second direction, said second direction crossing said first direction, wherein the first and second power bars are electrically and structurally connected to one another;

a plurality of hangers connected to the plurality of first power bars for hanging the platform assembly from a supporting structure; and at least one luminaire or light pendant electrically and structurally coupled to the platform assembly for selectively emitting light, wherein at least one of the hangers includes:

a first bar mount and a second bar mount spaced apart from one another, wherein the first bar mount selectively connects one of the first power bars with one of the second power bars, and the second bar mount selectively connects the one of the first power bars with another one of the second power bars;

a first bar having first and second ends and a second bar having first and second ends; and a cable having a first end and a second end, wherein the first end of the first bar and the first end of the second bar are connected to the first end of the cable, wherein the second end of the first bar is connected to the first bar mount and the second end of the second bar is connected to the second bar mount, and wherein the second end of the cable is selectively connected to the supporting structure.

14. The lighting system of claim 13, wherein the first bar mount electrically and structurally connects the one of the first power bars with the one of the second power bars.

15. The lighting system of claim 13, wherein the second power bars are disposed on top of the first power bars.

16. The lighting system of claim 15, further comprising a bar mount electrically and structurally connecting one of the first power bars with one of the second power bars at a location where the one of the first power bars overlaps with the one of the second power bars.

17. A lighting system comprising:

a platform assembly including a plurality of first power bars spaced apart from one another and extending in a first direction, and a plurality of second power bars spaced apart from one another and extending in a second direction, said second direction crossing said first direction, wherein the first and second power bars are electrically and structurally connected to one another;

a plurality of hangers connected to plurality of first power bars for hanging the platform assembly from a supporting structure; and at least one luminaire or light pendant electrically and structurally coupled to the platform assembly for selectively emitting light, wherein at least one of the hangers includes:

a cable having a first end and a second end;

a first bar having first and second ends and a second bar having first and second ends, wherein the first end of the first bar and the first end of the second bar are connected to the first end of the cable, and the second end of the cable is configured to be connected to the supporting structure; and a first bar connector structurally but not electrically connected to the second end of the first bar and a second bar connector structurally but not electrically connected to the second end of the second bar.

18. The lighting system of claim 17, wherein the first and second bar connectors are spaced apart from one another.

19. The lighting system of claim 17, wherein the second power bars are disposed on top of the first power bars.

20. The lighting system of claim 19, further comprising a bar mount electrically and structurally connecting one of the first power bars with one of the second power bars at a location where the one of the first power bars overlaps with the one of the second power bars.

* * * * *